US010410587B2

(12) United States Patent
Garbacea et al.

(10) Patent No.: US 10,410,587 B2
(45) Date of Patent: Sep. 10, 2019

(54) DISPLAY PIXEL CHARGE ACCUMULATION COMPENSATION SYSTEMS AND METHODS

(71) Applicant: APPLE INC., Cupertino, CA (US)

(72) Inventors: Ilie Garbacea, Cupertino, CA (US); Chaohao Wang, Sunnyvale, CA (US); Chengrui Le, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 225 days.

(21) Appl. No.: 15/274,035

(22) Filed: Sep. 23, 2016

(65) Prior Publication Data

US 2018/0090075 A1 Mar. 29, 2018

(51) Int. Cl.

*G09G 3/3291* (2016.01)
*G09G 3/36* (2006.01)
*G09G 3/3225* (2016.01)

(52) U.S. Cl.

CPC ..... *G09G 3/3291* (2013.01); *G09G 3/3225* (2013.01); *G09G 3/3648* (2013.01); *G09G 2300/0426* (2013.01); *G09G 2310/08* (2013.01); *G09G 2320/0252* (2013.01); *G09G 2320/0285* (2013.01); *G09G 2330/021* (2013.01); *G09G 2340/16* (2013.01)

(58) Field of Classification Search

CPC ..... G09G 2300/0426; G09G 2310/08; G09G 2320/0252; G09G 2320/0285; G09G 2330/021; G09G 2340/16; G09G 3/3225; G09G 3/3291; G09G 3/3648

See application file for complete search history.

(56) References Cited

U.S. PATENT DOCUMENTS

| | | | | |
|---|---|---|---|---|
| 8,487,919 | B2 * | 7/2013 | Kobayashi | G09G 3/3614 345/204 |
| 8,624,258 | B2 * | 1/2014 | Yamazaki | G09G 3/3233 257/72 |
| 8,975,632 | B2 * | 3/2015 | Yamazaki | G09G 3/3233 257/66 |
| 9,293,114 | B2 * | 3/2016 | Koide | G09G 5/10 |
| 9,495,926 | B2 * | 11/2016 | Tripathi | G09G 3/3614 |
| 9,747,847 | B2 * | 8/2017 | Rosenberg | G09G 3/344 |
| 9,799,291 | B2 * | 10/2017 | Hung | G09G 3/3659 |
| 9,830,871 | B2 * | 11/2017 | Slavenburg | G09G 3/3618 |
| 9,859,353 | B2 * | 1/2018 | Yamazaki | G09G 3/3233 |
| 9,922,608 | B2 * | 3/2018 | Wang | G09G 3/3614 |
| 9,997,121 | B2 * | 6/2018 | Wang | G09G 3/3614 |
| 2003/0058264 | A1 * | 3/2003 | Takako | G09G 3/3611 345/698 |

(Continued)

*Primary Examiner* — Michael J Jansen, II
(74) *Attorney, Agent, or Firm* — Fletcher Yoder, P.C.

(57) ABSTRACT

Systems and methods for improving displayed image quality of an electronic display including a display pixel that displays an image frame based at least in part on an analog electrical signal supplied to the display pixel are provided. In some embodiments, control circuitry instructs the electronic display to display the image frame based at least in part on an expected charge accumulation in the display pixel determined using a charge accumulation model that describes one or more electric fields expected to be present in the display pixel when displaying the image frame and that provides a display pixel state indicative of expected charge accumulation in the display pixel when the image frame is to be displayed based at least in part on the one or more electric fields.

17 Claims, 11 Drawing Sheets

(56) References Cited

U.S. PATENT DOCUMENTS

2003/0122759 A1* 7/2003 Abe ..... G09G 3/22 345/89
2010/0097360 A1* 4/2010 Cho ..... G09G 3/325 345/205
2011/0298767 A1* 12/2011 O'Callaghan ..... G02F 1/1337 345/208
2011/0309368 A1* 12/2011 Yamazaki ..... G09G 3/3233 257/71
2013/0015770 A1* 1/2013 Aitken ..... G09G 3/3406 315/154
2013/0249880 A1* 9/2013 Chen ..... G09G 3/36 345/211
2013/0249957 A1* 9/2013 Koide ..... G09G 5/10 345/690
2014/0110732 A1* 4/2014 Yamazaki ..... G09G 3/3233 257/88
2014/0176614 A1* 6/2014 Rosenberg ..... G09G 3/344 345/690
2015/0194111 A1* 7/2015 Slavenburg ..... G09G 3/3618 345/209
2015/0243233 A1* 8/2015 Bloks ..... G09G 3/3614 345/96
2015/0243234 A1* 8/2015 Bloks ..... G09G 3/3614 345/96
2015/0256765 A1* 9/2015 Shafer ..... H04N 5/32 250/370.08
2016/0155399 A1* 6/2016 Tripathi ..... G09G 3/3614 345/506
2016/0155407 A1* 6/2016 Gass ..... G09G 3/3648 345/691
2016/0204178 A1* 7/2016 Yamazaki ..... G09G 3/3233 257/71
2016/0343318 A1* 11/2016 Wang ..... G09G 3/3614
2016/0351138 A1* 12/2016 Wang ..... G09G 3/3614
2017/0092210 A1* 3/2017 Tann ..... G09G 3/3614
2017/0154591 A1* 6/2017 Hung ..... G09G 3/3659
2018/0061355 A1* 3/2018 Zheng ..... G09G 3/3685
2018/0090075 A1* 3/2018 Garbacea ..... G09G 3/3291
2018/0166032 A1* 6/2018 Wang ..... G09G 3/3614

* cited by examiner

DISPLAY PIXEL CHARGE ACCUMULATION COMPENSATION SYSTEMS AND METHODS

BACKGROUND

The present disclosure relates generally to electronic displays and, more particularly, to charge accumulation compensation in electronic displays.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use one or more electronic displays to present visual representations of information as text, still images, and/or video by displaying one or more image frames. For example, such electronic devices may include computers, mobile phones, portable media devices, tablets, televisions, virtual-reality headsets, and vehicle dashboards, among many others. To display an image frame, an electronic display may control light emission (e.g., actual luminance) from its display pixels, for example, based on image data that indicates target (e.g., desired) luminance of the display pixels. In particular, the light emission from a display pixel may depend on magnitude of analog electrical (e.g., voltage and/or current) signals supplied (e.g., applied) to the display pixel.

In addition to controlling magnitude, an electronic display may control polarity of analog electrical signals supplied to its display pixels. For example, to display a first image frame, the electronic display may supply a positive analog electrical signal to a display pixel. On the other hand, to display a second image frame, the electronic display may supply a negative analog electrical signal to the display pixel.

However, in some instances, supplying an analog electrical signal to a display pixel may inject charge into the display pixel, which results in charge accumulation that affects the magnitude of a subsequently supplied analog electrical signal. For example, a positive charge accumulation in a display pixel may increase the magnitude of a positive analog electrical supplied to the display pixel. On the other hand, a negative charge accumulation in a display pixel may decrease the magnitude of a positive analog electrical signal supplied to the display pixel. Since it is dependent on the magnitude of supplied analog electrical signals, charge accumulation in display pixels may result in actual luminance of display pixels varying from target luminance, which when perceivable may affect perceived image quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving displayed image quality of an electronic display. In some instances, charge accumulation in display pixels may affect actual (e.g., perceived) luminance of the display pixels. In fact, in some instances, charge accumulation in the display pixels may result in perceivable visual artifacts that affect perceived image quality of image frames displayed on the electronic display.

Thus, to facilitate improving perceived image quality, expected charge accumulation in the display pixels may be determined and operation of electronic display may be controlled (e.g., adjusted) accordingly. In some embodiments, expected charge accumulation may be determined based at least in part on a charge accumulation model that models (e.g., describes or indicates) expected operation of the display pixels. In particular, the charge accumulation model may be based at least in part on a modeling circuit that describes one or more electric fields expected to be present in a display pixel, which may accumulate (e.g., store) injected charge caused by displaying one or more image frames. To describe an electric field, in some embodiments, the modeling circuit may include an impedance circuit (e.g., resistor and capacitor coupled in parallel) corresponding to each component the display pixel through which the electric field is expected to flow.

In some embodiments, executing the charge accumulation model may provide a display pixel state indicative of expected charge accumulation in the display pixels. In particular, the display pixel state may be determined based at least in part on operation and/or simulated operation of the modeling circuit under various operational parameter sets. Since charge may accumulate over multiple image frames, in some embodiments, the display pixel state may be iteratively determined. For example, a current display pixel state may be determined based at least in part on a previous display pixel state and intervening operational parameters expected to affect charge accumulation.

Thus, in some embodiments, the display pixel state may be determined by iteratively operating and/or simulating operation of the modeling circuit based at least in part on operational parameters associated with display of one or more image frames. To facilitate reducing computational complexity and/or power consumption, in some embodiments, operation and/or simulated operation of the modeling circuit may be predetermined and characterized (e.g., represented) via response parameters, for example, stored in one or more look-up-tables based on corresponding operational parameters. In particular, the response parameters may describe change in display pixel state expected to be caused by previous operation of the electronic display and/or by charge injection resulting from supply of analog electrical signals to write an image frame.

To facilitate further reducing computational complexity and/or power consumption, in some embodiments, determination of display pixel may vary based at least in part on operating mode of the electronic display. For example, an initial display pixel state may be determined when the electronic display switches to an auto mode or a sleep mode, but subsequent iterative redetermination of the display pixel state may be paused while the electronic display remains in the auto mode or the sleep mode. Nevertheless, intervening operational parameters expected to affect charge accumulation may continue to be determined, such as a duration the electronic display operates in the auto mode or the sleep mode. In this manner, iterative redetermination of display pixel state may resume when the electronic display switches to a normal mode by iterating the initial display pixel state based at least in part on the intervening operational parameters.

In some embodiments, the expected charge accumulation associated with the display of an image frame may be determined based at least in part on the display pixel state, analog electrical signals used to write the image frame, and/or tuning parameters of the charge accumulation model, such as capacitance of impedance circuits in the modeling circuit. Based at least in part on the expected charge accumulation, operation of the electronic display and/or a display pipeline that supplies image data to the electronic display may be adjusted. For example, based at least in part on the expected charge accumulation, the electronic display may adjust refresh rate, display duration, and/or analog electrical signal polarities to facilitate reducing magnitude of charge accumulation in the display pixels. Additionally or alternatively, based at least in part on the expected charge accumulation, the display pixel may generate pixel response corrected image data, which when used to display an image frame is expected to compensate (e.g., offset) for charge accumulation in the display pixels. In this manner, operation of the electronic display and/or a display pipeline may be controlled to reduce likelihood of charge accumulation producing perceivable visual artifacts in displayed image frames, thereby improving perceived image quality.

BRIEF DESCRIPTION OF THE DRAWINGS

Various aspects of this disclosure may be better understood upon reading the following detailed description and upon reference to the drawings in which.

DETAILED DESCRIPTION

Figure 1:
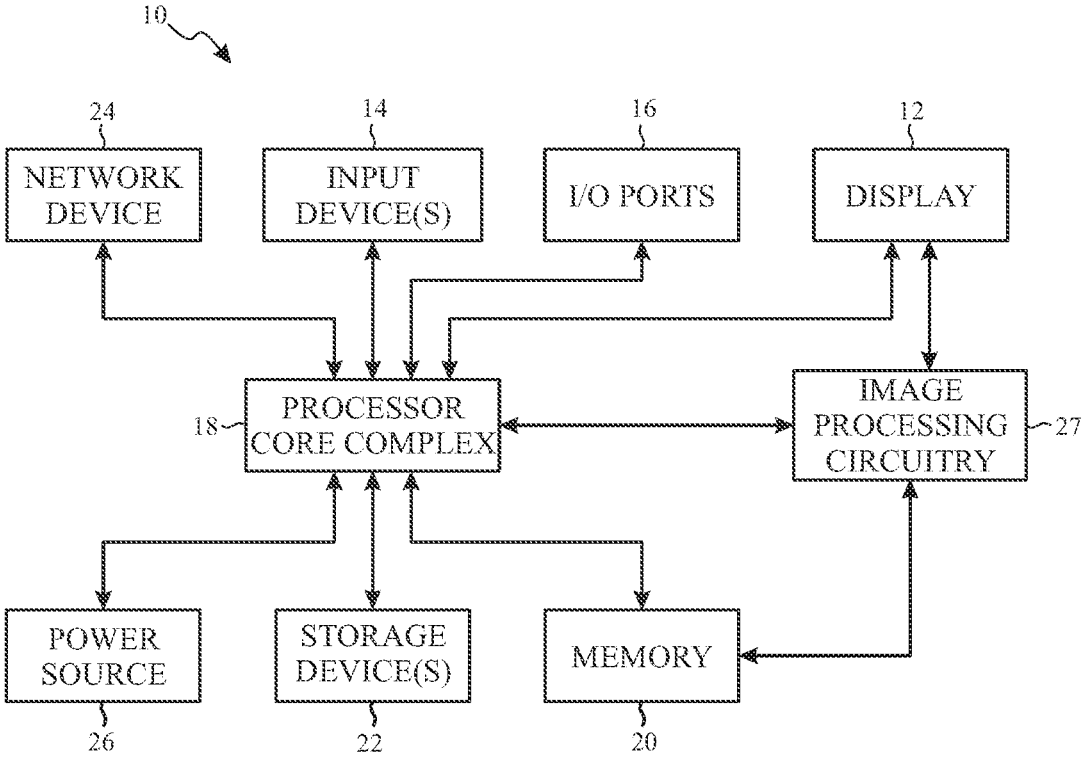
FIG. 1 is a block diagram of an electronic device including an electronic display used to display image frames, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, an electronic display may display an image frame by supplying analog electrical signals (e.g., voltage and/or current) to display pixels on a display panel. In some electronic displays, the analog electrical signal supplied to a display pixel may be stored in the display pixel to control light emission and, thus, perceived (e.g., actual) luminance of the display pixel. For example, in a liquid crystal display (LCD), a voltage signal supplied to a display pixel may be stored in a pixel electrode to produce an electric field, which controls light emission from the display pixel by adjusting adjusts orientation of liquid crystals. Additionally, in an organic light-emitting diode (OLED) display, a voltage signal supplied to a display pixel may be stored in the electric field of a capacitor, which controls control light emission from the display pixel by adjusting electrical power supplied to a self-emissive component.

Thus, supplying analog electrical signals to display image frames may inject charge, which may accumulate in the display pixels. For example, supplying a positive analog electrical signal to a display pixel may inject positive charge, which increases magnitude of positive charge accumulation or decreases magnitude of negative charge accumulation in the display pixel. On the other hand, supplying a negative analog electrical signal to a display pixel may inject negative charge, which increases magnitude of negative charge accumulation or decreases magnitude of positive charge accumulation in the display pixel.

In some instances, charge accumulation may affect magnitude of analog electrical signals supplied to the display pixels and, thus, actual luminance of the display pixels. For example, when a positive analog electrical signal is supplied, a positive charge accumulation in a display pixel may increase magnitude of the positive analog electrical signal, thereby increasing actual luminance of the display pixel. On the other hand, when a negative analog electrical signal is supplied, the positive charge accumulation in the display pixel may decrease magnitude of the negative analog electrical signal, thereby decreasing actual luminance of the display pixel. When perceivable, variations between actual luminance and target luminance of one or more display pixels may result in visual artifacts in a displayed image frame, thereby affecting perceived image quality.

Accordingly, the present disclosure provides techniques to facilitate improving perceived image quality of an electronic display by reducing likelihood of charge accumulation in display pixels producing perceivable visual artifacts. To facilitate improving perceived image quality, a controller (e.g., control circuitry) may control operation of the electronic display and/or a display pipeline that processes image data used by the electronic display based at least in part on expected charge accumulation in the display pixels. For example, based at least in part on the expected charge accumulation, the controller may control refresh rate and, thus, display duration of image frames to facilitate reducing magnitude of charge accumulation in the display pixels. Additionally or alternatively, based at least in part on the expected charge accumulation, the controller may instruct the display pipeline to generate pixel response corrected image data expected to compensate for charge accumulation in the display pixels.

Thus, to facilitate controlling operation, the controller may determine the expected charge accumulation in the display pixels. In some embodiments, charge accumulation may be dependent on various operational parameters associated with displaying one or more image frames. For example, the operational parameters expected to effect the charge accumulation in a display pixel may include magnitude of analog electrical signals supplied to the display pixel, polarity of analog electrical signals supplied to the display pixel, environmental conditions (e.g., temperature) when displaying image frames, display duration of image frames, refresh rate used to display image frames, and/or backlight luminance used to display image frames.

Based at least in part on determined operational parameters, the controller may utilize a charge accumulation model that provides a display pixel state indicative of the expected charge accumulation. In particular, the charge accumulation model may model (e.g., describe or indicate) expected operation of the display pixels under various sets of operational parameters. To facilitate determining the expected operation, in some embodiments, the charge accumulation model may be based at least in part on a modeling circuit that models flow of one or more electric fields expected to be present in a display pixel.

To model flow of an electric field, the modeling circuit may include one or more impedance circuits, such as a resistor and capacitor pair connected in parallel. In particular, an impedance circuit may model effect a component in the display pixel is expected to have on an electric field flowing through the component. For example, to model an electric field flowing from a pixel electrode to a common electrode in a display pixel, the modeling circuit may include a first impedance circuit that describes flow of the electric field through a passivation layer from the pixel electrode to a liquid crystal layer, a second impedance circuit that describes flow of the electric field through the liquid crystal layer, a third impedance circuit that describes flow of the electric field through the passivation layer from the liquid crystal layer to a dielectric layer, and a fourth impedance circuit that describes flow of the electric field through the dielectric layer from the passivation layer to the common electrode.

Based on operation and/or simulated operation of the modeling circuit, the controller may determine a display pixel state indicative of the expected charge accumulation. In some embodiments, the display pixel state may include voltages determined at one or more nodes in the modeling circuit. For example, the display pixel state may include a first voltage at a first node between the first impedance circuit and the second impedance circuit, a second voltage at a second node between the second impedance circuit and the third impedance circuit, and a third voltage at a third node between the third impedance circuit and the fourth impedance circuit.

Since charge accumulation may result from charge injection caused by displaying multiple image frames, in some embodiments, the controller may iteratively determine the display pixel state based at least in part on the charge accumulation model. For example, the controller may determine a current display pixel state by iterating the charge accumulation model from a previous display pixel state based at least in part on intervening and/or expected operational parameters. To iterate the charge accumulation model, in some embodiments, the controller may operate and/or simulate operation of the modeling circuit based on the intervening and/or expected operational parameters. To facilitate reducing computational complexity and/or power consumption, in some embodiments, the operation and/or simulated operation of the modeling circuit may be predetermined and represented via response parameters, for example, stored in one or more look-up-tables.

In particular, the response parameters may describe change in display pixel state and, thus, charge accumulation expected to be caused by the intervening and/or expected operational parameters. As described above, charge accumulation in a display pixel may result from charge injection caused by supplying an analog electrical signal to display an image frame. Thus, in some embodiments, the response parameters may include input response parameters that describe change in the display pixel state expected to be caused by the operational parameters related to charge injection, such as magnitude and/or polarity of analog electrical signals expected to be supplied to the display pixels.

Additionally, net charge accumulation in a display pixel may gradually change over time. For example, net charge accumulation may gradually decrease over time due to charge leakage from the display pixel. Thus, in some embodiments, the response parameters may include state response parameters that describe change in the display pixel state expected to be caused by the operational parameters related to net charge accumulation, such as display duration of a directly previous image frame, duration operating in a normal mode, and/or duration operating in an auto mode. In this manner, the controller may determine the current display pixel state by iterating the previous display pixel state based at least in part on the intervening and/or expected operational parameters.

In some embodiments, an electronic display may operate in various operating modes, which may have varying effects on charge accumulation. For example, when in a sleep mode, the controller may instruct the electronic display to cease displaying image frames (e.g., turn electronic display off). Additionally, when in an auto mode, the controller may instruct the electronic display to display image frames using a constant (e.g., 60 Hz) refresh rate and, thus, a constant (e.g., 16.66 ms) display duration.

Furthermore, when in a normal mode, the controller may instruct the electronic display to display image frames using a variable refresh rate. In some embodiments, when in the normal mode, the controller may dynamically adjust the refresh rate and, thus, the display duration of image frames based on various factors. For example, to facilitate reducing power consumption, the controller may instruct the electronic display to reduce refresh rate and, thus, increase display duration of image frames. On the other hand, to facilitate improving perceived image quality, the controller may instruct the electronic display to increase refresh rate and, thus, reduce display duration of image frames, for example, to reduce motion blur.

In some instances, magnitude of charge injection may be dependent at least in part on display duration of an image frame. For example, displaying a first image frame approximately 16.66 ms may inject more charge into a display pixel compared to displaying a second image frame approximately 8.33 ms. As such, operating in the normal mode may affect charge accumulation more drastically and/or less predictably compared to operating in the sleep mode and/or the auto mode.

Thus, in some embodiments, the controller may determine expected charge accumulation based at least in part on the charge accumulation model before displaying each image frame when operating in the normal mode. For example, based at least in part on the state response parameters, the controller may determine expected charge accumulation at the end of a previous image frame. Additionally, based at least in part on the input response parameters, the controller may determine expected charge accumulation after a current image frame is displayed.

As described above, to facilitate improving displayed image quality, the controller may instruct the electronic display to adjust refresh rate and, thus, display duration of image frames based at least in part on the expected charge accumulation. For example, when magnitude of the expected charge accumulation is greater than a charge accumulation threshold and expected charge accumulation polarity is the same as expected analog electrical signal polarity, the controller may instruct the electronic display to split the image frame. In particular, the controller may instruct the electronic display to initially display the image frame with a shortened (e.g., 120 Hz) refresh rate followed by a repeat of the image frame using an opposite polarity analog electrical signal. In this manner, when operating in the normal mode, the controller may actively control operation of the electronic display to facilitate reducing charge accumulation and, thus, likelihood of charge accumulation causing perceivable visual artifacts.

Nevertheless, in some instances, charge accumulation in the display pixels may still be present and, thus, changing while operating in the sleep mode or the auto mode. For example, when operating in the sleep mode or the auto mode, charge accumulation resulting from previous operation in the normal mode may still be present in the display pixels. Additionally, when operating in the auto mode, the fixed display duration of image frames may result in charge injection caused by displaying successive image frames to generally cancel. In some instances, difference in magnitude of analog electrical signals used to display successive image frames may still result in a net change in the charge accumulation. Nevertheless, over time, effects on charge accumulation resulting from different magnitude analog electrical signals may generally cancel, thereby resulting in gradual decrease magnitude of net charge accumulation.

Thus, to facilitate improving perceived image quality, the controller may account for changes in charge accumulation resulting from operation in the sleep mode and/or the auto mode, for example, to reduce likelihood of overcompensation when switching to the normal mode. In some embodiments, similar to the normal mode, the controller may periodically re-determine the expected charge accumulation based at least in part on the charge accumulation model. For example, when operating in the auto mode, the controller may iteratively determine the expected charge accumulation before displaying each image frame. However, using the charge accumulation model may increase processing performed by the controller and, thus, power consumption, computational complexity, and/or latency (e.g., delay bottleneck).

As described above, changes in charge accumulation resulting from operation in the sleep mode and/or the normal mode may generally be less drastic and/or more predictable compared to the normal mode. Thus, in some embodiments, the controller may account for changes in charge accumulation resulting from operation in the sleep mode and/or the auto mode with less granularity (e.g., frequency), which may facilitate reducing processing performed by the controller. For example, when switching to the sleep mode or the auto mode, the controller may determine an initial display pixel state indicative of an initial charge accumulation. Additionally, while operating in the sleep mode or the auto mode, the controller may pause iterative redetermination of the display pixel state, but continue keeping track of intervening operational parameters (e.g., duration and/or environmental conditions) expected to affect charge accumulation.

Thus, when switching to the normal mode, the controller may resume iterative redetermination of the display pixel state and, thus, expected charge accumulation by iterating the initial display pixel state based at least in part on the charge accumulation model and the intervening operational parameters. For example, the controller may determine response parameters corresponding with the intervening operational parameters determined while operating in the sleep mode or the auto mode. Additionally, the controller may apply the response parameters to advance the initial display pixel state to a current display pixel state indicative of the expected charge accumulation. In this manner, the present disclosure may facilitate improving perceived image quality of an electronic display by providing techniques for determining expected charge accumulation in display pixels and adjusting operation accordingly to reduce likelihood of charge accumulation causing perceivable visual artifacts.

To help illustrate, an electronic device 10 including an electronic display 12 is shown in FIG. 1. As will be described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. Thus, the processor core complex 18 may execute instruction stored in local memory 20 and/or the main memory storage device 22 to perform operations, such as generating and/or transmitting image data. As such, the processor core complex 18 may include one or more general purpose microprocessors, one or more application specific processors (ASICs), one or more field programmable logic arrays (FPGAs), or any combination thereof.

In addition to instructions, the local memory 20 and/or the main memory storage device 22 may store data to be processed by the processor core complex 18. Thus, in some embodiments, the local memory 20 and/or the main memory storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and/or the like.

As depicted, the processor core complex 18 is also operably coupled with the network interface 24. In some embodiments, the network interface 24 may facilitate communicating data with another electronic device and/or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or LTE cellular network.

Additionally, as depicted, the processor core complex 18 is operably coupled to the power source 26. In some embodiments, the power source 26 may provide electrical power to one or more component in the electronic device 10, such as the processor core complex 18 and/or the electronic display 12. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the one or more I/O ports 16. In some embodiments, an I/O ports 16 may enable the electronic device 10 to interface with other electronic devices. For example, when a portable storage device is connected, the I/O port 16 may enable the processor core complex 18 to communicate data with the portable storage device.

As depicted, the electronic device 10 is also operably coupled with the one or more input devices 14. In some embodiments, an input device 14 may facilitate user interaction with the electronic device 10, for example, by receiving user inputs. Thus, an input device 14 may include a button, a keyboard, a mouse, a trackpad, and/or the like. Additionally, in some embodiments, an input device 14 may include touch-sensing components in the electronic display 12. In such embodiments, the touch sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by displaying image frames based at least in part on corresponding image data. As depicted, the electronic display 12 is operably coupled to the processor core complex 18 and the image processing circuitry 27. In this manner, the electronic display 12 may display image frames based at least in part on image data generated by the processor core complex 18, the image processing circuitry 27. Additionally or alternatively, the electronic display 12 may display image frames based at least in part on image data received via the network interface 24, an input device, and/or an I/O port 16.

Figure 2:
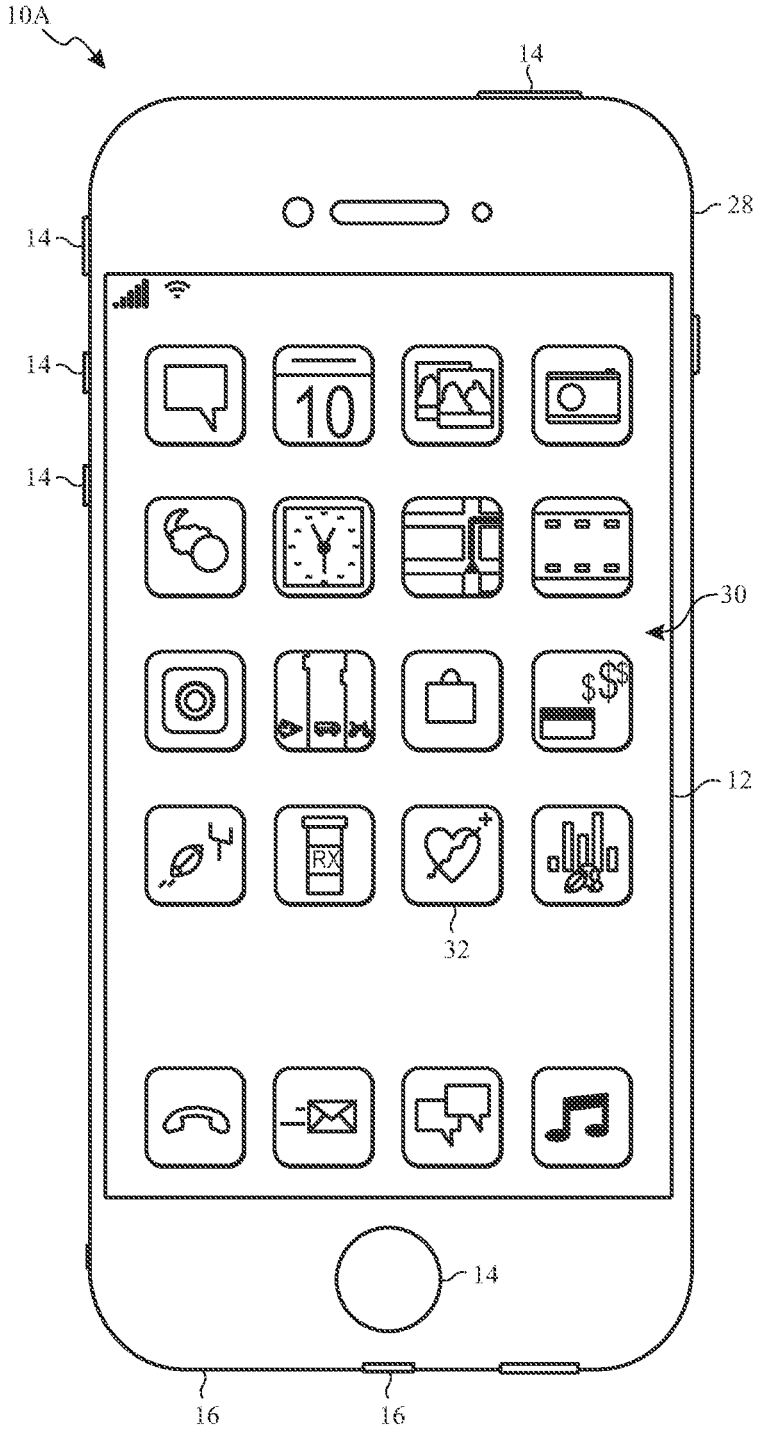
FIG. 2 is one example of the electronic device of FIG. 1, in accordance with an embodiment of the present disclosure.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For illustrative purposes, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
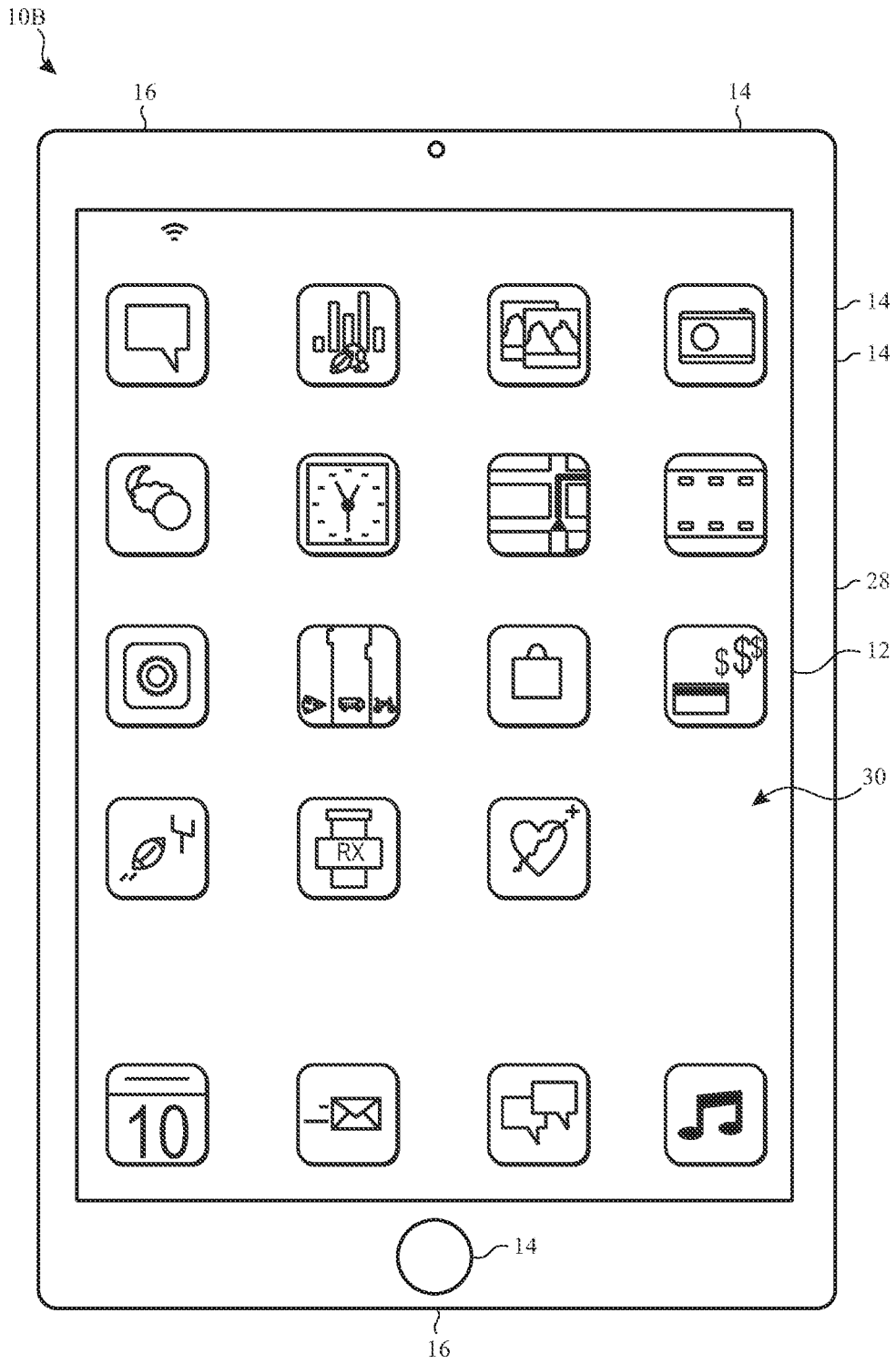
FIG. 3 is another example of the electronic device of FIG. 1, in accordance with an embodiment of the present disclosure.
Figure 4:
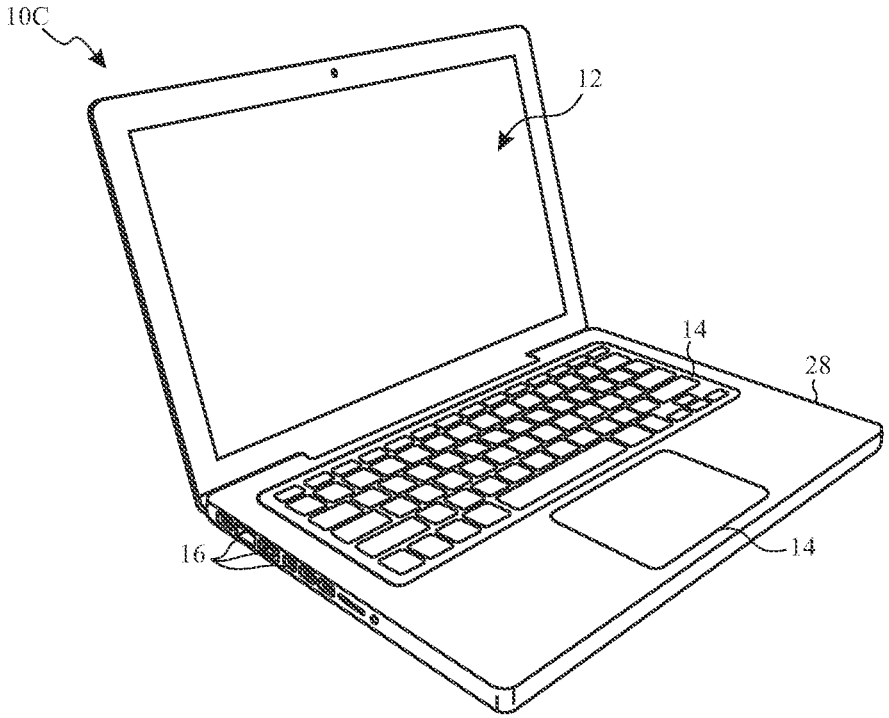
FIG. 4 is another example of the electronic device of FIG. 1, in accordance with an embodiment of the present disclosure.
Figure 5:
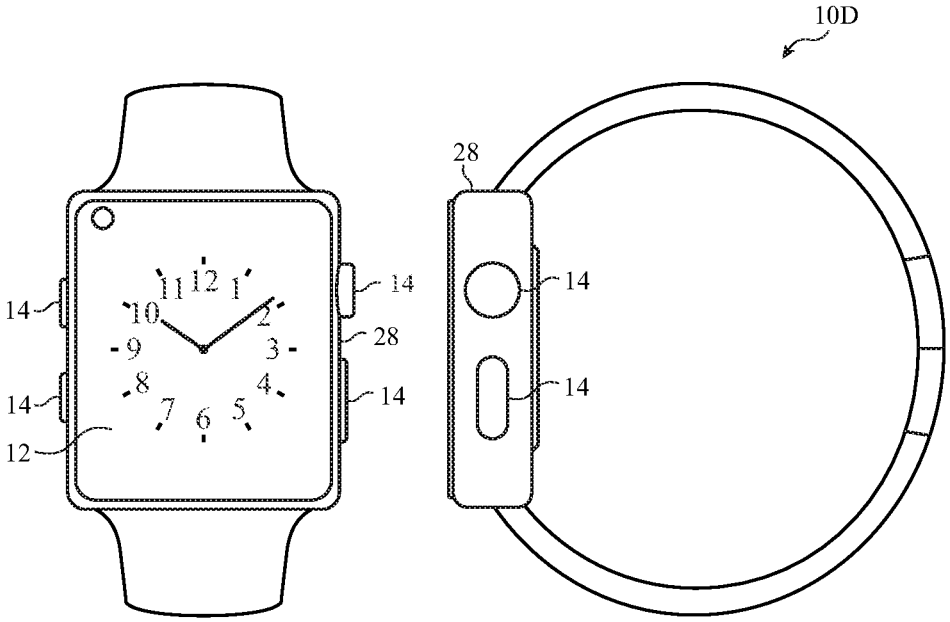
FIG. 5 is another example of the electronic device of FIG. 1, in accordance with an embodiment of the present disclosure.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

As described above, the electronic display 12 may display image frames based on image data received, for example, from the processor core complex 18 and/or the image processing circuitry 27. In some embodiments, a display pipeline may analyze and/or process the image data, for example, to determine pixel response corrected image data that compensates for expected charge accumulation in display pixels of the electronic display 12. Additionally, in some embodiments, a display driver may generate and supply analog electrical signals to the display pixels to display an image frame based at least in part on image data received from the display pipeline.

Figure 6:
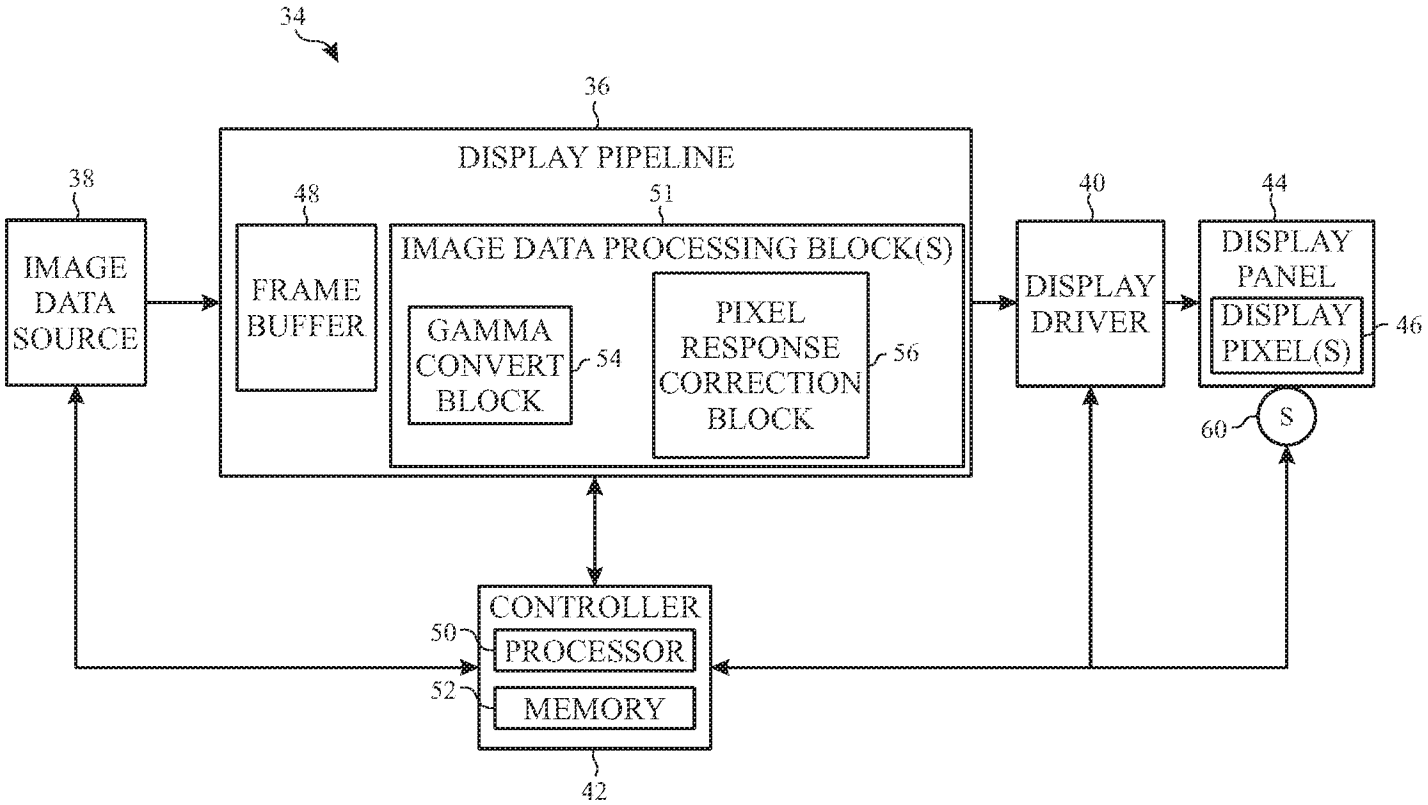
FIG. 6 is block diagram of a portion of the electronic device of FIG. 1 used to display image frames, in accordance with an embodiment of the present disclosure.

To help illustrate, a portion 34 of the electronic device 10 including a display pipeline 36 and a display driver 40 is shown in FIG. 6. In some embodiments, the display pipeline 36 and/or the display driver 40 may be implemented in the electronic device 10, the electronic display 12, or a combination thereof. For example, the display pipeline 36 may be included in the processor core complex 18, the image processing circuitry 27, a timing controller (TCON) in the electronic display 12, other one or more processing units, other processing circuitry, or any combination thereof.

As depicted, the portion 34 of the electronic device 10 also includes an image data source 38, a controller 42 (e.g., control circuitry), and a display panel 44, which includes one or more display pixels 46. In some embodiments, the controller 42 may control operation of the display pipeline 36, the image data source 38, and/or the display driver 40. To facilitate controlling operation, the controller 42 may include a controller processor 50 and controller memory 52. In some embodiments, the controller 42 may control operation based at least in part on circuit connections (e.g., logic gates) formed in the controller 42.

Additionally or alternatively, the controller processor 50 may execute instructions stored in the controller memory 52. Thus, in some embodiments, the controller processor 50 may be included in the processor core complex 18, the image processing circuitry 27, a timing controller in the electronic display 12, a separate processing unit, separate processing circuitry, or any combination thereof. Additionally, in some embodiments, the controller memory 52 may be included in the local memory 20, the main memory storage device 22, a separate tangible, non-transitory, computer readable medium, or any combination thereof.

Furthermore, to facilitate controlling operation, the controller 42 may be communicatively coupled to one or more sensors 60. In some embodiments, a sensor 60 may determine (e.g., measure) sensor data indicative of operational parameters that are expected to affect display of image frames. For example, the one or more sensors 60 may include a temperature sensor that communicates sensor data indicative of display panel 44 temperature to the controller 42.

In the depicted embodiment, the display pipeline 36 is communicatively coupled to the image data source 38. In this manner, the display pipeline 36 may receive image data from the image data source 38. As described above, in some embodiments, the image data source 38 may be included in the processor core complex 18, the image processing circuitry 27, or a combination thereof.

Additionally, in the depicted embodiment, the display pipeline 36 is communicatively coupled to the display driver 40. In this manner, the display driver 40 may receive image data from the display pipeline 36 and write image frames to the display panel 44 based at least in part on the received image data. To write an image frame, the display driver 40 may supply analog electrical (e.g., voltage or current) signals to the display pixels 46 on the display panel 44. In this manner, the display pixels 46 may control light emission based at least in part on received analog electrical signals to facilitate displaying the image frame on the electronic display 12.

To facilitate improving perceived image quality, the display pipeline 36 may analyze and/or process the image data before a corresponding image frame is displayed. To facilitate analyzing and/or processing image data, the display pipeline 36 may include an image data buffer 48 used to store image data. In some embodiments, the image data buffer 48 may store image data received from the image data source 38, image data to be processed, image data already processed by the display pipeline 36, and/or image data to be supplied to the display driver 40. For example, the image data buffer 48 may store image data corresponding to one or more previous image frames, which may be indicative of analog electrical signals used to display the one or more previous image frames.

Additionally, the display pipeline 36 may include one or more image data processing blocks 51 that operate to analyze and/or process image data. For example, in the depicted embodiment, the image data processing blocks 51 include a gamma convert block 54 and a pixel response correction (PRC) block 56. Additionally, in some embodiments, the image data processing blocks 51 may include an ambient adaptive pixel (AAP) block, a dynamic pixel backlight (DPB) block, a white point correction (WPC) block, a sub-pixel layout compensation (SPLC) block, a burn-in compensation (BIC) block, a panel response correction (PRC) block, a dithering block, a sub-pixel uniformity compensation (SPUC) block, a content frame dependent duration (CDFD) block, an ambient light sensing (ALS) block, or any combination thereof.

As described above, the display pipeline 36 may receive image data from the image data source 38. In some embodiments, the image data received from the image data source 38 may indicate target luminance (e.g., grayscale level) of display pixels 46 for displaying an image frame in a linear domain. However, the human eye generally perceives luminance in a gamma (e.g., non-linear) domain. As such, to facilitate achieving target luminance, the gamma convert block 54 may convert linear domain image data into gamma domain image data. For example, the gamma convert block 54 may convert 8-bit or 10-bit linear domain image data into 14-bit gamma domain image data, which when used to display an image frame may facilitate reducing variation between perceived luminance and target luminance of the display pixels 46.

However, in some instances, display pixels 46 may have varying light emission responses to supplied analog electrical signals, for example, due at least in part to charge accumulation in the display pixels 46. In particular, when polarity of a supplied analog electrical signal and polarity of charge accumulation in a display pixel 46 are the same, light emission from the display pixel may be greater compared to when the polarities are opposite. Additionally, effect on light emission from a display pixel 46 caused by charge accumulation in the display pixel 46 may increase as magnitude of the charge accumulation increases.

As described above, charge accumulation in the display pixels 46 may result from charge injection caused by supplying analog electrical signals to the display pixels 46. In some embodiments, supplied analog electrical signals may produce electric fields in the display pixels 46, for example, to control light emission. However, the electric fields may also accumulate (e.g., store) charge in the display pixels 46.

Figure 7:
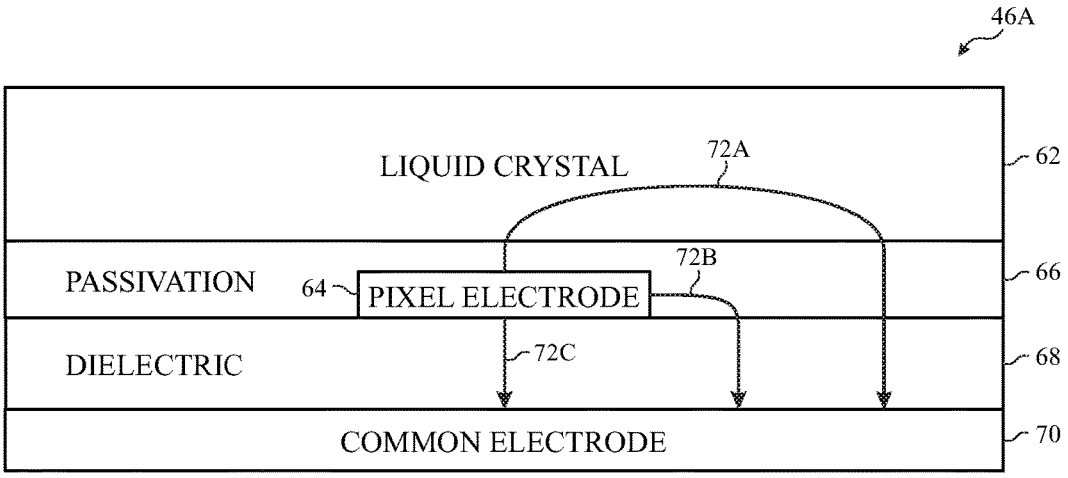
FIG. 7 is a cross-sectional view of a display pixel in the electronic display of FIG. 1, in accordance with an embodiment of the present disclosure.

To help illustrate, one example of a display pixel 46A is shown in FIG. 7. As depicted, the display pixel 46A includes a liquid crystal layer 62, a pixel electrode 64, a passivation layer 66, a dielectric layer 68, and a common electrode 70. Thus, in some embodiments, the display pixel 46A may be used in an LCD electronic display. However, it should be appreciated that the display pixel 46A is described merely illustrative. In other words, the techniques may additionally or alternatively be applied in other suitable types of electronic display 12.

As described above, the display driver 40 may supply analog electrical signals to a display pixel 46. In particular, with regard to the depicted embodiment, the display driver 40 may supply a positive pixel voltage signal to the pixel electrode 64 and a common voltage signal to the common electrode 70. Thus, in the depicted embodiment, the common electrode 70 is at a common voltage (e.g., 0V) while the pixel electrode 64 is at a positive voltage. Due to the voltage difference, electric fields 72 may flow from the pixel electrode 64 to the common electrode 70.

For example, as depicted, a first electric field 72A flows from the pixel electrode 64 through the passivation layer 66, through the liquid crystal layer 62, back through the passivation layer 66, and through the dielectric layer 68 to the common electrode 70. In this manner, the first electric field 72A may control orientation of liquid crystals in the liquid crystal layer 62 and, thus, light emission from the display pixel 46A. Additionally, a second electric field 72B flows from the pixel electrode 64 through the passivation layer 66 and the dielectric layer 68 to the common electrode 70. Furthermore, a third electric field 72C flows from the pixel electrode 64 through the dielectric layer 68 to the common electrode 70.

Thus, similar to a capacitor, charge may be stored (e.g., accumulated) in the electric fields 72 present in a display pixel 46. However, as described above, charge accumulation in a display pixel 46 may affect pixel response and, thus, actual luminance of the display pixel 46. In fact, in some instances, variations in pixel response may result in actual luminance of display pixels 46 differing from their target luminance, which may be perceivable as visual artifacts on displayed image frames.

Thus, returning to FIG. 6, the pixel response correction block 56 may facilitate improving perceived image quality by compensating for expected variations in pixel response. In particular, the pixel response correction block 56 may map input (e.g., gamma domain) image data into pixel response corrected image data based on operational parameters, such as expected display duration of a corresponding image frame, which may be determined based at least in part on charge accumulation expected to be present when the image frame is to be displayed. For example, when the input image data is 14-bit gamma domain image data, the pixel response correction block 56 may output 14-bit pixel response corrected image data based at least in part on expected pixel response. In this manner, the display pipeline 36 may enable the display driver 40 to write an image frame to the display pixels 46 based at least in part on the pixel response corrected image data, thereby reducing likelihood that charge accumulation causes perceivable visual artifacts in the displayed image frame and, thus, improving perceived image quality.

To facilitate further reducing likelihood of perceivable visual artifacts, in some embodiments, the electronic display 12 may adjust operation based at least in part on the expected charge accumulation. For example, the display driver 40 may adjust polarity of analog electrical signals supplied to the display pixels 46 and/or display duration of image frames to facilitate reducing magnitude of charge accumulation in the display pixels 46. Thus, to facilitate improving perceived image quality, the expected charge accumulation may be determined.

Figure 8:
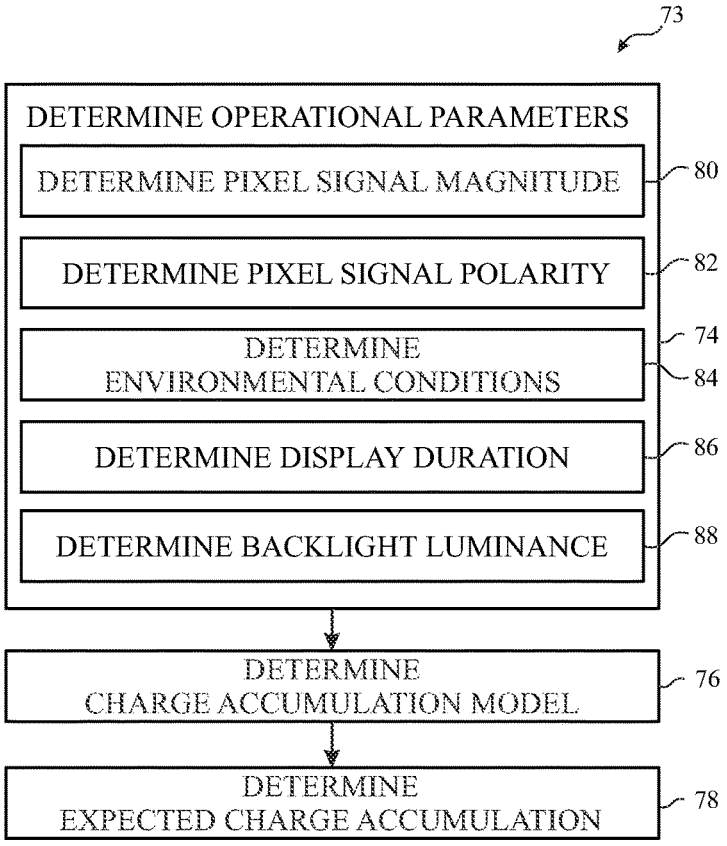
FIG. 8 is a flow diagram of a process for determining expected charge accumulation in the display pixel of FIG. 7, in accordance with an embodiment of the present disclosure.

One embodiment of a process 73 for determining expected charge accumulation is described in FIG. 8. Generally, the process 73 includes determining operational parameters (process block 74), determining a charge accumulation model (process block 76), and determining the expected charge accumulation (process block 78). In some embodiments, the process 73 may be implemented based on circuit connections formed in the display pipeline 36. Additionally or alternatively, in some embodiments, the process 73 may be implemented by executing instructions stored in a tangible, non-transitory, computer-readable medium, such as the controller memory 52, using a processor, such as the controller processor 50.

Accordingly, in some embodiments, the controller 42 may determine operational parameters expected to affect charge accumulation in the display pixel 46 (process block 74). In some embodiments, the controller 42 may determine operational parameters associated with display of one or more image frames. For example, to determine expected charge accumulation before a current image frame is displayed, the controller 42 may determine intervening operational parameters associated with display of a directly previous image frame. Additionally, to determine expected charge accumulation after the current image frame is displayed, the controller 42 may determine intervening operational parameters associated with display of the directly pervious image frame and expected operational parameters associated with display of the current image frame. As described above, the operational parameters expected to affect charge accumulation may include analog electrical signal magnitude used to display image frames, analog electrical signal polarity used to display image frames, environmental conditions, display duration of image frames, refresh rate used to display image frames, and/or backlight luminance used to display image frames.

Thus, in some embodiments, determining the operational parameters may include determining magnitude of analog electrical signals associated with display of the one or more image frames (process block 80). In some embodiments, the controller 42 may determine magnitude of analog electrical signals expected to be used to display a current image frame based at least in part on the pixel response corrected image data generated by the pixel response correction block 56. Since the image data buffer 48 may store image data used to display previous image frames, the controller 42 may determine magnitude of analog electrical signals used to display one or more of the previous image frames based at least in part on image data stored in the image data buffer 48.

Additionally, in some embodiments, determining the operational parameters may include determining polarity of analog electrical signals associated with display of the one or more image frames (process block 82). In some embodiments, the controller 42 may determine polarity of analog electrical signals supplied to the display pixels 46 based at least in part on an inversion scheme implemented by the electronic display 12. For example, the electronic display 12 may implement an inversion scheme that alternates polarity of analog electrical signals supplied to each display pixel 46 to display successive image frames. Thus, in some embodiments, the controller 42 may determine polarity of analog electrical signals used to display an image frame based at least in part on polarity of analog electrical signals used to display a directly previous image frame.

Furthermore, in some embodiments, determining the operational parameters may include determining environmental conditions associated with display of the one or more image frames (process block 84). In some embodiments, the environmental conditions may include temperature, humidity, and/or atmospheric pressure surrounding the display panel 44. To facilitate determining the environmental conditions, the controller 42 may receive sensor data from one or more sensors 60 indicative of the environmental conditions.

In some embodiments, determining the operational parameters may also include determining display duration and, thus, refresh rate associated with display of the one or more image frames (process block 86). In some embodiments, the controller 42 may determine display duration of image frames based at least in part on operating mode of the electronic display 12. For example, when in the auto mode, the controller 42 may determine that a fixed (e.g., 60 Hz) refresh rate is used and, thus, image frames have a constant (e.g., 16.66 ms) display duration. When in the normal mode, the controller 42 may determine the refresh rate and, thus, display duration based at least in part on when the display pipeline 36 receives image data from the image data source 38 and/or timing parameters (e.g., stamps) indicated in the image data.

Additionally, in some embodiments, determining the operational parameters may include determining backlight luminance associated with display of one or more image frames (process block 88). In some embodiments, the controller 42 may control backlight luminance based at least in part on ambient light conditions. Thus, to determine the backlight luminance, the controller 42 may determine ambient light conditions present when an image frame is displayed. As such, in some embodiments, the sensors 60 may also include an ambient light sensor that determines and communicates sensor data indicative of ambient light around (e.g., in-front) the display panel 44 to the controller 42. In this manner, the controller 42 may determine the expected ambient light conditions and, thus, the expected backlight luminance by analyzing received sensor data.

Additionally, the controller 42 may determine a charge accumulation model (process block 76). As described, the charge accumulation model may model (e.g., describe or indicate) expected operation of the display pixels 46. Additionally, as described above, the charge accumulation model may be based at least in part on a modeling circuit that models flow of one or more electric fields expected to be present in a display pixel 46.

Figure 9:
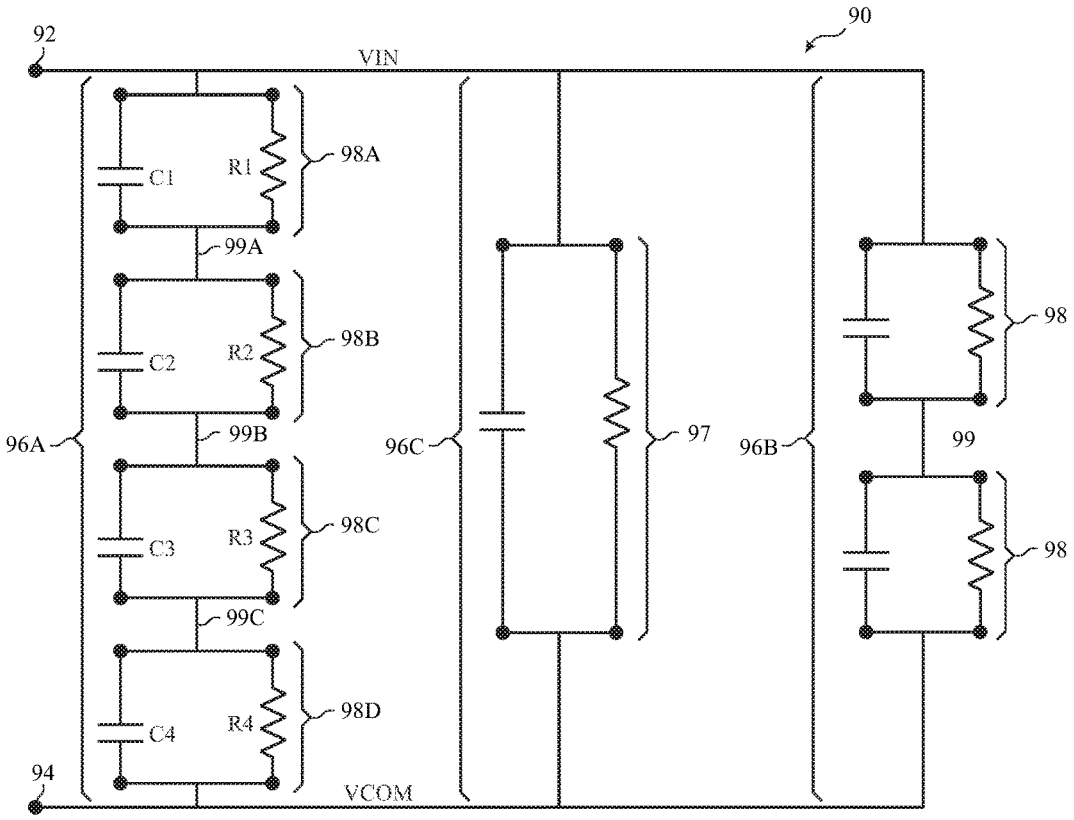
FIG. 9 is a circuit diagram of a modeling circuit used in a charge accumulation model, in accordance with an embodiment of the present disclosure.

To help illustrate, one embodiment of a modeling circuit 90 is shown in FIG. 9. In some embodiments, the modeling circuit 90 may be used to model operation of the display pixel 46A described above. It should be appreciated that the described modeling circuit 90 is merely intended to be illustrative. In other words, a modeling circuit 90 may be used to model other suitable types of display pixels 46.

As described above, electric fields may be generated based at least in part on analog electrical signals supplied to the pixel electrode 64 and/or the common electrode 70. Thus, to model the electric fields, the modeling circuit 90 includes a first bus 92, which may receive a pixel voltage signal (Vin) expected to be supplied to the pixel electrode 64. The modeling circuit 90 also includes a second bus 94, which may receive the common voltage signal (Vcom) expected to be supplied to the common electrode 70.

Additionally, the modeling circuit 90 may include one or more branches 96 coupled in parallel between the first bus 92 and the second bus 94. In some embodiments, each branch 96 may model (e.g., describe or represent) one electric field expected to be present in the display pixel 46A. For example, in the depicted embodiment, the modeling circuit 90 includes a first branch 96A that describes the first electric field 72A, a second branch 96B that describes the second electric field 72B, and a third branch 96C that describes the third electric field 72C. Additionally, in some embodiments, each branch 96 may include one or more impedance circuits 98 connected in series between the first bus 92 and the second bus 94. For example, in the depicted embodiment, the impedance circuit 98 includes a resistor and a capacitor pair coupled in parallel.

In some embodiments, each impedance circuit 98 on a branch 96 may correspond to one component in the display pixel 46A through which the corresponding electric field flows. For example, in the depicted embodiment, the first branch 96A includes a first impedance circuit 98A that describes flow of the first electric field 72A through the passivation layer 66 from the pixel electrode to the liquid crystal layer 62, a second impedance circuit 98B that describes flow of the first electric field 72A through the liquid crystal layer 62 from the passivation layer 66 back to the passivation layer 66, a third impedance circuit 98C that describes flow the first electric field 72A through the passivation layer 66 from the liquid crystal layer 62 to the dielectric layer 68, and a fourth impedance circuit 98D that describes flow the first electric field 74A through the dielectric layer 68 from the passivation layer 66 to the common electrode 70. Similarly, the second branch 96B and the third branch 96C may each include one or more impedance circuits 98 coupled in series.

In some embodiments, the first branch 96A may be sufficient to model charge accumulation in the display pixel 46A, for example, since the first electric field 72A flows through the liquid crystal layer 62 while the second electric field 72B and the third electric field 72C do not. Thus, in some embodiments, the modeling circuit 90 may include only the first branch 96A, which may facilitate reducing computational complexity used simulate operation of the modeling circuit 90 and/or power consumption used to operate the modeling circuit 90.

As described above, the modeling circuit 90 may facilitate determining a display pixel state indicative of the expected charge accumulation. In some embodiments, the display pixel state may include voltage at nodes 99 between impedance circuits 98 resulting from operation of the modeling circuit 90 under various sets of operational parameters. For example, with regard to the depicted embodiment, the display pixel state may include a first voltage (V1) at a first node 99A between the first impedance circuit 98A and the second impedance circuit 98B, a second voltage (V2) at a second node 99B between the second impedance circuit 98B and the third impedance circuit 98C, and a third voltage (V3) at a third node 99C between the third impedance circuit 98C and the fourth impedance circuit (V4).

To facilitate improving accuracy, the charge accumulation model may include various tuning parameters that may be calibrated based on characteristics of display pixels 46 expected to be implemented in an electronic display 12. In some embodiments, the tuning parameters may include impedance value of the impedance circuits 98 in the modeling circuit 90. For example, with regard to the depicted embodiment, the tuning parameters may include a first resistance (R1) of the first impedance circuit 98A, a first capacitance (C1) of the first impedance circuit 98A, a second resistance (R2) of the second impedance circuit 98B, a second capacitance (C2) of the second impedance circuit 98B, a third resistance (R3) of the third impedance circuit 98C, a third capacitance (C3) of the third impedance circuit 98C, a fourth resistance (R4) of the fourth impedance circuit 98D, and a fourth capacitance (C4) of the fourth impedance circuit 98D.

Figure 10:
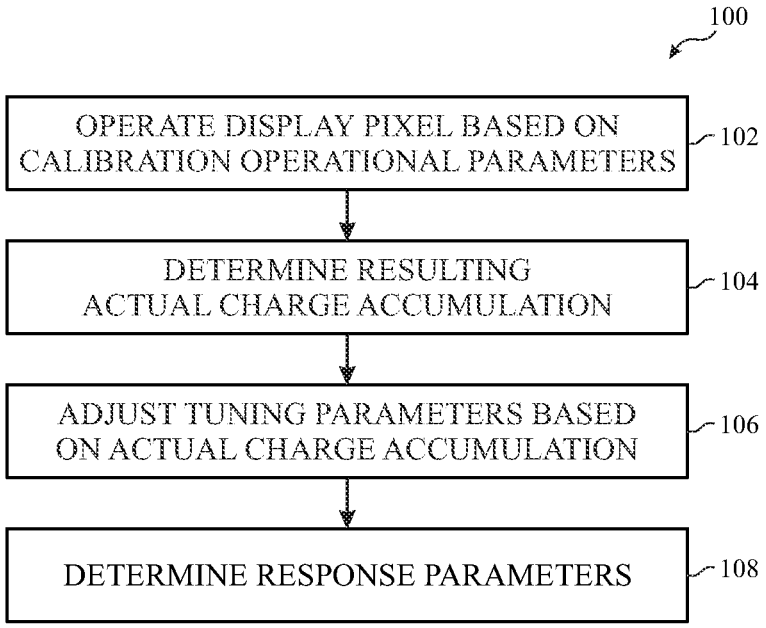
FIG. 10 is a flow diagram of a process for calibrating the charge accumulation model, in accordance with an embodiment of the present disclosure.

One embodiment of a process 100 for calibrating a charge accumulation model is described in FIG. 10. Generally, the process includes operating a display pixel based on calibration operational parameters (process block 102), determining resulting actual charge accumulation in the display pixel (process block 104), adjusting tuning parameters based on the actual charge accumulation (process block 106), and determining response parameters (process block 108). In some embodiments, the process 100 may be implemented by a manufacturer, for example, using a calibration system. Additionally, in some embodiments, the process 100 may be implemented by executing instructions stored in a tangible, non-transitory, computer-readable medium, such as the controller memory 52 or memory in the calibration system, using a processor, such as the controller processor 50 or a processor in the calibration system.

Accordingly, in some embodiments, a calibration system may operate a display pixel 46 based on calibration operational parameters (process block 102). In some embodiments, the calibration operational parameters may include one or more operational parameter sets expected to be present when operating an electronic display 12. Additionally, in some embodiments, the calibration operational parameters may include sequences of varying operational parameter sets.

By operating the display pixel 46 based on the calibration operational parameters, the calibration system may determine actual charge accumulation resulting in the display pixel 46 (process block 104). In some embodiments, the actual charge accumulation may be determined based at least in part on sensor data indicative of voltage stored in the display pixel 46. Additionally, in some embodiments, the actual charge accumulation may be determined between image frames and/or at changes in the calibration operational parameters.

Based at least in part on the actual charge accumulation, the calibration system may adjust tuning parameters in the charge accumulation model (process block 106). In some embodiments, the tuning parameters may be adjusted such that a charge accumulation determined based on the modeling circuit 90 approximates the actual charge accumulation. Additionally or alternatively, the tuning parameters may be adjusted based on characteristics of components in the display pixel 46. For example, impedance (e.g., resistance and/or capacitance) of the first impedance circuit 98A may be adjusted based on impedance of the passivation layer 66, impedance of the second impedance circuit 98B may be adjusted based on impedance of the liquid crystal layer 62, impedance of the third impedance circuit 98C may be adjusted based on impedance of the of the passivation layer 66, and impedance of the fourth impedance circuit 98D may be adjusted based on impedance of the dielectric layer 68. In this manner, the modeling circuit 90 may be calibrated to the display pixel 46 and, thus, indicate a corresponding display pixel state when operated based on various operational parameters.

In some embodiments, the calibration system may represent operation of the modeling circuit 90 via response parameters (process block 108). As described above, the response parameters may indicate expected change in display pixel state caused by charge injection and/or change in net charge accumulation over time. For example, the response parameters may include input response parameters that indicated expected effect on the display pixel state resulting from charge injection. Additionally, the response parameters may include state response parameters that indicate expected effect on the display pixel state resulting from change in net charge accumulation over time.

Thus, in some embodiments, the response parameters may be determined by operating and/or simulating operation of the modeling circuit 90 after the tuning parameters are calibrated. In particular, the response parameters may be determined based on changes in the display pixel state indicated by the modeling circuit 90 when operated using various operational parameter sets, for example, included in the calibration operational parameters. Additionally or alternatively, the response parameters may be determined directly based on operation of the display pixel 46.

In this manner, a calibrated charge accumulation model may be determined. In some embodiments, the charge accumulation model may be predetermined and stored in a tangible, non-transitory, computer-readable medium, such as the controller memory 52. For example, response parameters corresponding with different operational parameter sets may be stored using one or more look-up-tables. Additionally or alternatively, model data enabling simulating operation of the modeling circuit 90 may be stored. As such, in some embodiments, controller 42 may determine the charge accumulation model by retrieving data (e.g., model data and/or response parameters) used to implement the charge accumulation model.

Returning to the process 73 of FIG. 8, the controller 42 may determine the expected charge accumulation based at least in part on the determined operational parameters and the charge accumulation model (process block 78). As described above, the controller 42 may iteratively determine a display pixel state indicative of the expected charge accumulation. Thus, in some embodiments, the controller 42 may determine the display pixel state by iteratively operating and/or simulating operation of the modeling circuit 90 using the determined operational parameters, for example, based on the model data. Additionally or alternatively, the controller 42 may iterate the display pixel state based at least in part on the response parameters corresponding with the determined operational parameters.

Figure 11:
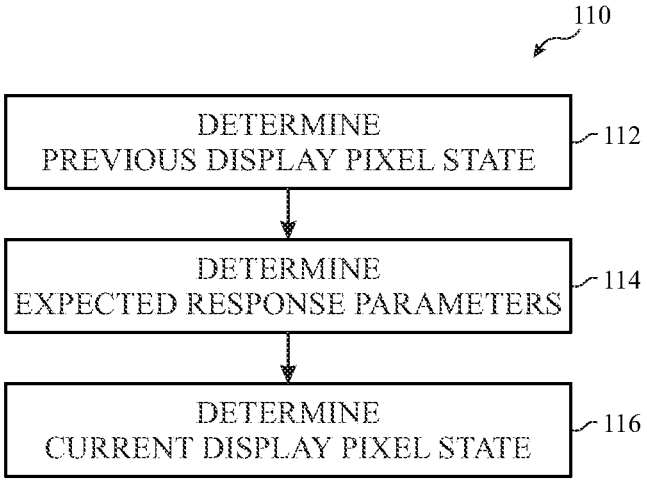
FIG. 11 is a flow diagram of a process for determining a current state of a display pixel used to determine the expected charge accumulation, in accordance with an embodiment of the present disclosure.

To help illustrate, one embodiment of a process 110 for determining a display pixel state is described in FIG. 11. Generally, the process 110 includes determining a previous display pixel state (process block 112), determining expected response parameters (process block 114), and determining a current display pixel state (process block 116). In some embodiments, the process 110 may be implemented based on circuit connections formed in the display pipeline 36. Additionally or alternatively, in some embodiments, the process 110 may be implemented by executing instructions stored in a tangible, non-transitory, computer-readable medium, such as the controller memory 52, using a processor, such as the controller processor 50.

Accordingly, in some embodiments, controller 42 may determine a previously determined display pixel state (process block 112). In some embodiments, previously determined display pixel states may be stored in a tangible, non-transitory, computer-readable medium, such as the controller memory 52. As such, the controller 42 may retrieve a previous display pixel state, for example, from the controller memory 52. In some embodiments, to facilitate accuracy, the previous display pixel state retrieved may be the most recently determined display pixel state.

Additionally, the controller 42 may determine expected response parameters based at least in part on the determined operational parameters (process block 114). In particular, the controller 42 may select the response parameters corresponding with the determined operational parameters. As described above, the response parameters may include input response parameters and/or state response parameters. In some embodiments, the type of response parameters determined may vary based at least in part on when the expected charge accumulation is to be determined. For example, the controller 42 may determine state response parameters to facilitate determining expected charge accumulation before an image frame is displayed (e.g., end of a previous image frame. Additionally, the controller 42 may determine input response parameters and state response parameters to facilitate determining expected charge accumulation when the image frame is displayed.

Based at least in part on the previous display pixel state and the expected response parameters, the controller 42 may determine a current display pixel state (process block 116). In some embodiments, the controller 42 may determine the current display pixel state as follows:

$$V_k = IR * Vin_k + SR * \begin{bmatrix} Vin_{k-1} \\ V_{k-1} \end{bmatrix} \quad (1)$$

where $V_k$ is the current display pixel state, IR is in the input response parameter, $Vin_k$ is the currently supplied analog electrical signal, SR is the state response parameter, $Vin_{k-1}$ is the previously supplied analog electrical signal, and $V_{k-1}$ is the previous display pixel state. As described above, in some embodiments, determination of display pixel state may vary based at least in part on operating mode of the electronic display 12.

Figure 12:
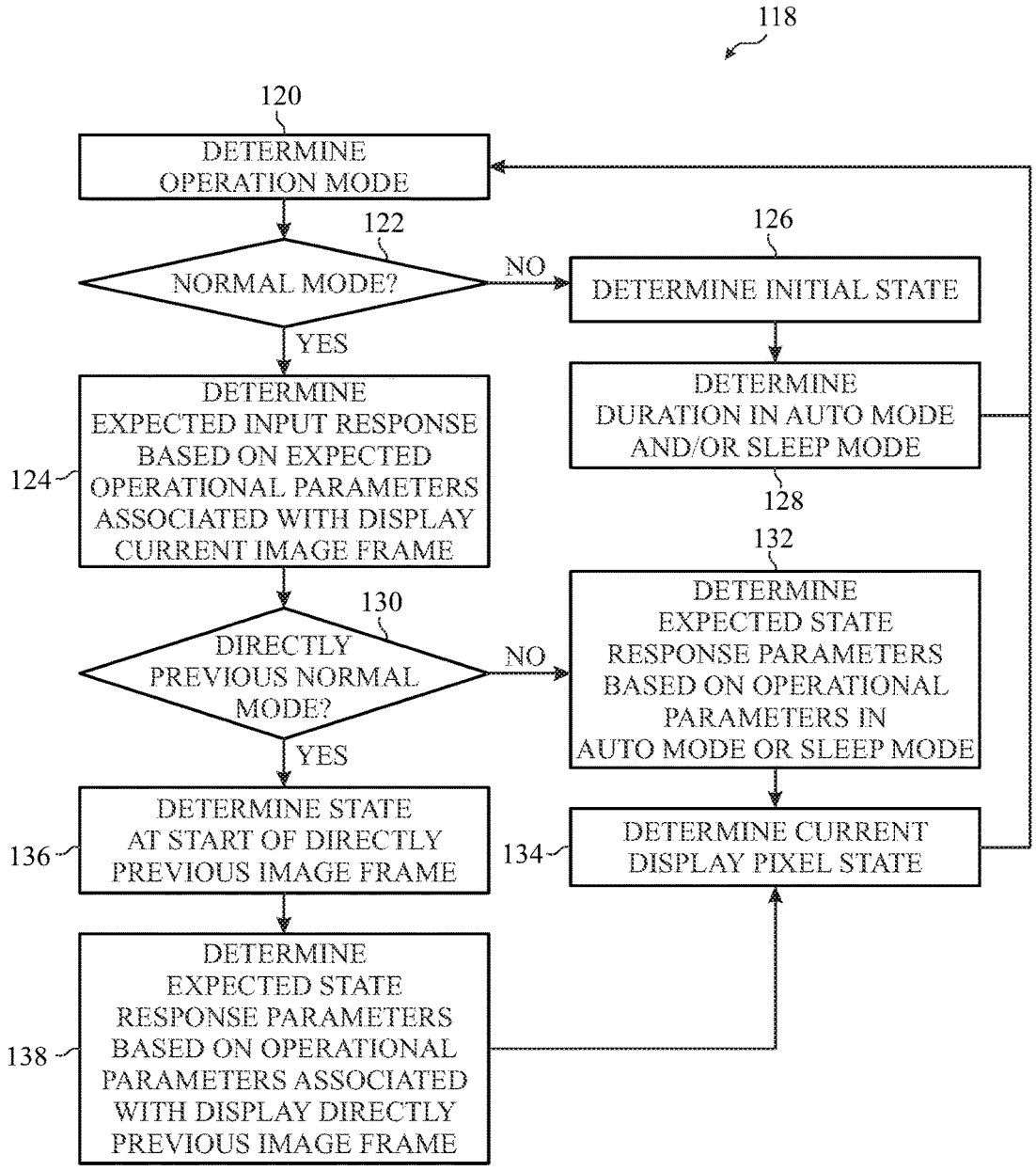
FIG. 12 is a flow diagram of a process for determining the current state based on operating mode, in accordance with an embodiment of the present disclosure.

To help illustrate, one embodiment of a process 118 for determining a display pixel state based on operating mode of the electronic display 12 is described in FIG. 12. Generally, the process 118 includes determining an operating mode (process block 120), determining whether the operating mode is a normal mode (decision block 122), and determining expected input response parameters based at least in part on expected operational parameters associated with displaying a current image frame when the operating mode is the normal mode (process block 124). When not the normal mode, the process 118 includes determining an initial display pixel state (process block 126) and determining operational parameters while operating in an auto mode or a sleep mode (process block 128).

Additionally, the process 118 includes a directly previous operating mode is the normal mode (decision block 130). When the directly previous operating mode is not the normal mode, the process 118 includes determining expected state response parameters based at least in part on the operational parameters determined while operating in the auto mode or the sleep mode (process block 132) and determining the current display pixel state (process block 134). When the directly previous operating mode is the normal mode, the process 118 includes determining a display pixel state at the start of the directly previous image frame (process block 136), determining expected state response parameters based at least in part on operational parameters associated with displaying the directly previous image frame (process block 138), and determining the current display pixel state (process block 134). In some embodiments, the process 118 may be implemented based on circuit connections formed in the display pipeline 36. Additionally or alternatively, in some embodiments, the process 118 may be implemented by executing instructions stored in a tangible, non-transitory, computer-readable medium, such as the controller memory 52, using a processor, such as the controller processor 50.

Accordingly, in some embodiments, the controller 42 may determine operating mode of the electronic display 12 (process block 120). As described above, operation of the electronic display 12 may vary based at least in part on the operating mode. For example, when operating in the sleep mode, the electronic display 12 may cease displaying image frames. Additionally, when operating in the auto mode, the electronic display 12 may display image frames using a constant (e.g., fixed) refresh rate and, thus, a constant display duration. Furthermore, when operating in the normal mode, the electronic display 12 may display image frames using a variable refresh rate and, thus, variable display durations.

When the electronic display 12 is operating in the auto mode or the sleep mode, the controller 42 may determine an initial display pixel state (process block 126). In other words, the controller 42 may determine a display pixel state when the electronic display 12 initially switches to the auto mode or the sleep mode. In some embodiments, the controller 42 may determine the initial display pixel state by iterating a previous display pixel state, for example, using the process 110 described above.

Additionally, the controller 42 may keep track of intervening operational parameters expected to affect charge accumulation while the electronic display 12 operates in the auto mode or the sleep mode (process block 128). In particular, the intervening operational parameters may include duration the electronic display 12 operates in the auto mode or the sleep mode. Additionally, in some embodiments, the operational parameters may include environmental parameters, the constant refresh rate used when operating in the auto mode, the constant display duration used when operating in the auto mode, magnitude of analog electrical signals used to display image frames in the auto mode, and/or polarity of analog electrical signals used to display image frames in the auto mode.

Thus, while operating in the auto mode or the sleep mode, the controller 42 may pause iterative redetermination of the display pixel state. Instead, the controller 42 may merely determine an initial display pixel state and intervening operational parameters that enable resuming iterative determination of the display pixel state after switching to the normal mode. In some embodiments, the controller 42 may pause iterative redetermination of the display pixel state since ability of the controller 42 to adjust operation of the electronic display 12 may be limited while operating in the auto mode or the sleep mode. Moreover, in some embodiments, pausing iterative redetermination of the display pixel state may facilitate reducing processing performed by the controller 42 and, thus, computational complexity, power consumption, and/or latency.

On the other hand, when the electronic display 12 is operating in the normal mode, the controller 42 may determine expected input response parameters based at least in part on expected operational parameters associated with displaying a current image frame (process block 124). As described above, the input response parameters may describe charge injection expected to be caused by displaying an image frame. Accordingly, in some embodiments, the controller 42 may determine the expected input response parameters based at least in part on magnitude and/or polarity of analog electrical signals expected to be used to display the current image frame.

Additionally, the controller 42 may determine whether the electronic display 12 was operating in the normal mode directly prior to when a current image frame is to be displayed (decision block 130). As described above, determination of display pixel state may vary when operating in the normal mode compared to the auto mode or the sleep mode. Thus, determining whether the directly previous operating mode is the auto mode may enable the controller 42 to adjust how the current display pixel state is determined.

For example, when the directly previous operating mode is the auto mode or the sleep mode, the controller 42 may determine expected state response parameters based on the operational parameters determined while the electronic display 12 was operating in the sleep mode or the auto mode (process block 132). In this manner, the controller 42 may determine expected change in net charge accumulation while the electronic display 12 was operating in the sleep mode or the auto mode. In some embodiments, the effect on net charge accumulation may vary when operating in the normal mode compared to operating in the sleep mode. As such, in some embodiments, the controller 42 may determine the expected state response parameters based at least in part on whether previously operating in the normal mode, the auto mode, or both. Additionally, the controller 42 may determine the current display pixel state by iterating the initial display pixel state based at least in part on the expected input response parameters and/or the expected state response parameters (process block 134).

On the other hand, when the directly previous operating mode is the normal mode, the controller 42 may determine the display pixel state at the start of a directly previous image frame (process block 136). Additionally, the controller 42 may determine the expected state response parameters based at least in part on intervening operational parameters associated with displaying the directly previous image frame (process block 138). In this manner, the controller 42 may determine expected change in net charge accumulation while displaying the directly previous image frame. Furthermore, the controller 42 may determine the current display pixel state by iterating the display pixel state at the start of the directly previous image frame based at least in part on the expected input response parameters and/or the expected state response parameters (process block 134).

Based at least in part on the current display pixel state, the controller 42 may determine the expected charge accumulation. For example, in some embodiments, the controller 42 may determine the expected charge accumulation as follows:

$$Q = \frac{Vin}{C2\left(\frac{1}{C1} + \frac{1}{C2} + \frac{1}{C3} + \frac{1}{C4}\right)} - (V1 - V2) \tag{2}$$

where Q is the expected charge accumulation, Vin is the supplied analog electrical signal, C1 is the capacitance in the first impedance circuit 84A, C2 is the capacitance in the second impedance circuit 84B, C3 is the capacitance in the third impedance circuit 84C, C4 is the capacitance in the fourth impedance circuit 84D, V1 is the voltage at the first node 99A, and V2 is the voltage at the second node 99B.

As described above, to facilitate improving displayed image quality, the controller 42 may control operation of the display pipeline 36 and/or the electronic display 12 based at least in part on the expected charge accumulation. For example, the controller 42 may determine an expected display duration based at least in part on the expected charge accumulation and instruct the pixel response correction block 56 to determine pixel response corrected image data accordingly. In particular, the pixel response correction block 56 may generate pixel response corrected image data expected to compensate for charge accumulation in the display pixels 46. Additionally or alternatively, the controller 42 may instruct the electronic display 12 to adjust display of image frames to facilitate reducing magnitude of charge accumulation in the display pixels 46.

Figure 13:
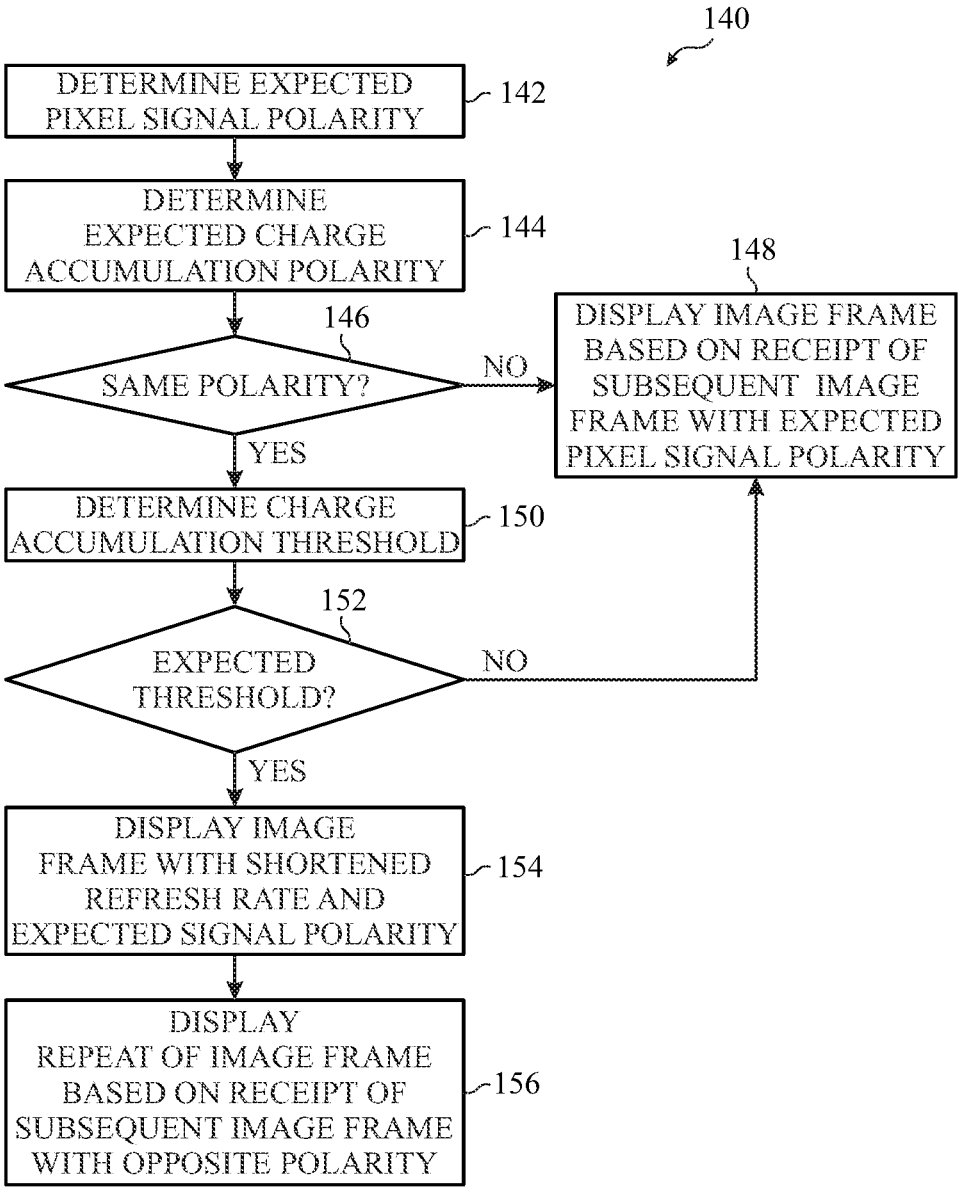
FIG. 13 is a flow diagram of a process for controlling operation of the electronic display based at least in part on the expected charge accumulation, in accordance with an embodiment of the present disclosure.

To help illustrate, one embodiment of a process 140 for controlling display of image frames on an electronic display 12 is described in FIG. 13. Generally, the process 140 includes determining expected pixel signal polarity (process block 142), determining expected charge accumulation polarity (process block 144), determining whether the expected pixel signal polarity and the expected charge accumulation polarity are the same (process block 146), and displaying an image frame with the expected pixel signal polarity based on receipt of subsequent image frames when the polarities are not the same (process block 148). When the polarities are the same, the process 140 includes determining a charge accumulation threshold (process block 150) and determining whether magnitude of expected charge accumulation is greater than the charge accumulation threshold (decision block 152).

When greater than the charge accumulation threshold, the process 140 includes displaying the image frame with a shortened refresh rate and the expected pixel signal polarity (process block 154) and displaying a repeat of the image frame based on receipt of the subsequent image frame with an opposite pixel signal polarity (process block 156). In some embodiments, the process 140 may be implemented based on circuit connections formed in the display pipeline 36. Additionally or alternatively, in some embodiments, the process 140 may be implemented by executing instructions stored in a tangible, non-transitory, computer-readable medium, such as the controller memory 52, using a processor, such as the controller processor 50.

Accordingly, in some embodiments, controller 42 may determine expected polarity of analog electrical signals to be supplied to display pixels 46 to display an image frame (process block 142). In some embodiments, the controller 42 may determine the expected polarity based at least in part on an inversion scheme implemented by the electronic display 12. Additionally, in some embodiments, the controller 42 may determine the expected polarity based at least in part on location of display pixels 46 on the display panel 44.

The controller 42 may also determine polarity of expected charge accumulation in the display pixels 46 (process block 144). In some embodiments, the controller 42 may determine the expected charge accumulation based at least in part on a current display pixel state, for example, using the process 73, the process 110, and/or equation (2) described above. Based at least on value of the expected charge accumulation, the controller 42 may determine polarity and magnitude of the expected charge accumulation.

When polarity of the expected charge accumulation and the analog electrical signal to be used to display the image frame are the same, the controller 42 may determine a charge accumulation threshold (process block 150). In some embodiments, different charge accumulation thresholds may be utilized depending on polarity of the expected charge accumulation. Thus, in such embodiments, the controller 42 may determine the charge accumulation threshold based at least in part on polarity of the expected charge accumulation.

Additionally, the controller 42 may compare magnitude of the expected charge accumulation with the charge accumulation threshold (decision block 152). When the expected charge accumulation is not greater than the charge accumulation threshold and/or the polarities are not the same, the controller 42 may instruct the electronic display 12 to display the image frame using the expected analog electrical signal polarity (process block 148). Additionally, in some embodiments, the controller 42 may instruct the electronic display 12 to display the image frame based at least in part on image data corresponding with a subsequent image frame. For example, the controller 42 may control refresh rate and/or display duration of the image frame based at least in part on when the display pipeline 36 receives image data corresponding with the subsequent image frame and/or timing data indicated in the image data corresponding with the subsequent image frame.

On the other hand, when the expected charge accumulation is greater than the charge accumulation threshold, the controller 42 may instruct the electronic display 12 to display the image frame with a shortened refresh rate using the expected analog electrical signal polarity (process block 154). In some embodiments, the shortened refresh rate may be the highest refresh rate and, thus, shortest display duration the electronic display 12 is capable of implementing to minimize increase in magnitude of the charge accumulation caused by displaying the image frame while alternating analog electrical signal polarity in successive image frames, for example, to facilitate reducing likelihood of producing a perceivable luminance spike in the image frame. Thus, in some embodiments, the shortened refresh rate may be 120 Hz.

Additionally, the controller 42 may instruct the electronic display 12 to subsequently display a repeat of the image frame using analog electrical signals with the opposite polarity (process block 156). In some embodiments, the controller 42 may instruct the electronic display 12 to display the repeat image frame based at least in part on image data corresponding with a subsequent image frame. For example, the controller 42 may control refresh rate and/or display duration of the repeat image frame based at least in part on when the display pipeline 36 receives image data corresponding with the subsequent image frame and/or timing data indicated in the image data corresponding with the subsequent image frame. In this manner, electronic display 12 may split display of the image frame to facilitate reducing magnitude of charge accumulation in the display pixels 46.

Figure 14:
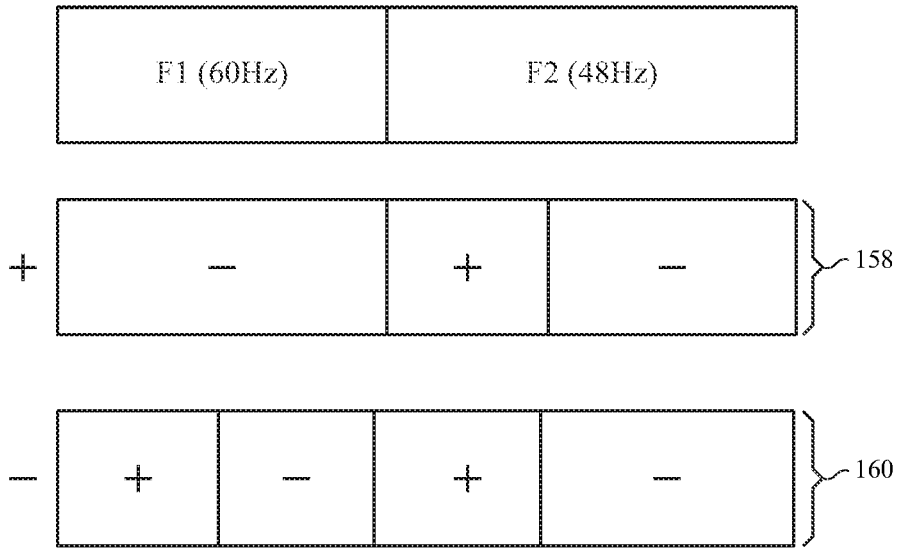
FIG. 14 is a diagrammatic representation of analog electrical signal polarities supplied to a display pixel, in accordance with embodiment of the present disclosure.

To help illustrate splitting of image frames, timing diagrams describing display of a first image frame (F1) and a second image frame (F2) are shown in FIG. 14. In particular, a first timing diagram 158 describes polarity of analog electrical signals supplied to a first display pixel 46 with a positive charge accumulation when a directly previous image frame is displayed using a positive analog electrical signal. Additionally, a second timing diagram 160 describes polarity of analog electrical signal supplied to a second display pixel 46 with a positive charge accumulation when a directly previous image frame is displayed using a negative analog electrical signal.

With regard to the depicted embodiment, the first image frame has a target refresh rate of 60 Hz, for example, due to image data corresponding with the second image frame being received approximately 16.66 ms after image data corresponding with the first image frame. Based at least in part on the corresponding image data, as depicted in the first timing diagram 158, the first image frame is displayed by supplying a negative analog electrical signal to the first display pixel 46 since the directly previous image frame is displayed using a positive analog electrical signal. Additionally, since polarity of the analog electrical signal is opposite the polarity of the charge accumulation, the first image frame is displayed as a single 60 Hz image frame.

On the other hand, as depicted in the second timing diagram 160, the first image frame is initially displayed by supplying a positive analog electrical signal to the second display pixel 46 since the directly previous image frame is displayed using a negative analog electrical signal. However, since polarity of the analog electrical signal is the same as polarity of the charge accumulation, the first image frame is split. In particular, the first image frame is initially displayed with a shortened refresh rate by supplying the positive analog electrical signal to the second display pixel 46 followed by a repeat of the first image frame, which is displayed by supplying a negative analog electrical signal to the second display pixel 46.

Additionally, the second image frame has a target refresh rate of 48 Hz, for example, due to image data corresponding with a directly subsequent image frame being receive approximately 20.83 ms after image data corresponding with the second image frame. Based at least in part on the corresponding image data, as depicted in the first timing diagram 158 and the second timing diagram 160, the second image frame is initially displayed using a positive analog electrical signal since the directly previous image frame is displayed using a negative analog electrical signal. However, since polarity of the analog electrical signal is the same as polarity of the charge accumulation, the second image frame is split. In particular, the second image frame is displayed with a shortened refresh rate using the positive analog electrical signal followed by a repeat of the second image frame displayed using a negative analog electrical signal.

In this manner, image frames may be split to facilitate reducing increase of the charge accumulation above a charge accumulation threshold while alternating polarity of analog electrical signals supplied to each display pixel 46 for displaying successive image frames. In some embodiments, the pixel response correction block 56 may generate pixel response corrected image data based at least in part on an expected display duration, which may be determined based at least in part on actual display duration of one or more previous image frames. As such, in some embodiments, splitting an image frame may additionally effect generation of pixel response corrected image data. In other embodiments, the controller 42 may instruct the electronic display to deviate from alternating analog electrical signal polarities used to display successive image frames. For example, with regard to the second timing diagram 160, the controller 42 may instruct the electronic display 12 to display the first image frame as a single 60 Hz image frame using a negative analog electrical signal.

Accordingly, the technical effects of the present disclosure include improving perceived image quality by reducing likelihood of charge accumulation in display pixels producing a perceivable visual artifact. In some embodiments, a charge accumulation model may be used to iteratively determine a display pixel state indicative of expected charge accumulation in the display pixels. Based at least in part on the expected charge accumulation, operation of a display pipeline and/or an electronic display may be controlled. For example, based at least in part on the expected charge accumulation, the display pipeline may generate pixel response corrected image data expected to compensate for charge accumulation in the display pixels. Additionally, based at least in part on the expected charge accumulation, the electronic display may adjust refresh rate, display duration, and/or pixel signal polarity to facilitate reducing magnitude of charge accumulation in the display pixels.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display panel comprising a display pixel, wherein:

the display pixel comprises a pixel electrode, a liquid crystal layer, and a common electrode; and the display panel is configured to display an image frame based at least in part on a first electric field resulting in the liquid crystal layer due to supply of an analog electrical signal to the pixel electrode of the display pixel; and control circuitry communicatively coupled to the display panel, wherein the control circuitry is configured to:

determine expected charge accumulation in the display pixel based at least in part on a modeling circuit comprising:

a first branch configured to model the first electric field that flows from the pixel electrode to the common electrode through the liquid crystal layer, a passivation layer, and a dielectric layer;

a second branch coupled in parallel with the first branch and configured to model a second electric field that flows from the pixel electrode to the common electrode through the passivation layer and the dielectric layer; and a third branch coupled in parallel with the first branch and the second branch and configured to model a third electric field that flows from the pixel electrode, through the dielectric layer, to the common electrode; and instruct the display panel to display the image frame based at least in part on the expected charge accumulation in the display pixel when the image frame is to be displayed.

2. The electronic device of claim 1, wherein:

the modeling circuit models:

a first bus configured to receive a first voltage corresponding to one or more analog electrical signals previously supplied to the pixel electrode of the display pixel; and a second bus configured to receive a second voltage corresponding to one or more common voltage signals previously supplied to the common electrode of the display pixel;

the first branch is modeled as a plurality of impedance circuits coupled in series between the first bus and the second bus; and the second branch is modeled as one or more impedance circuits coupled in series between the first bus and the second bus in parallel with the first branch.

3. The electronic device of claim 2, wherein:

the display pixel comprises:

the passivation layer formed between the pixel electrode and the liquid crystal layer; and the dielectric layer formed between the passivation layer and the common electrode; and the first branch of the of the modeling circuit models:

a first impedance circuit electrically coupled to the first bus, wherein the first impedance circuit is configured to model flow of the first electric field from the pixel electrode, through the passivation layer, to the liquid crystal layer;

a second impedance circuit electrically coupled in series with the first impedance circuit, wherein the second impedance circuit is configured to model flow of the first electric field from the passivation layer, through the liquid crystal layer, and back to the passivation layer;

a third impedance circuit electrically coupled in series with the second impedance circuit, wherein the third impedance circuit is configured to model flow of the first electric field from the liquid crystal layer, through the passivation layer, to the dielectric layer; and a fourth impedance circuit electrically coupled to the second bus and electrically coupled in series with the third impedance circuit, wherein the fourth impedance circuit is configured to model flow of the first electric field from the passivation layer, through the dielectric layer, to the common electrode.

4. The electronic device of claim 3, wherein the control circuitry is configured to determine a display pixel state indicative of the expected charge accumulation in the display pixel when the image frame is to be displayed based at least in part on:

a second voltage at a first node between the first impedance circuit and the second impedance circuit on the first branch of the modeling circuit;

a third voltage at a second node between the second impedance circuit and the third impedance circuit on the first branch of the modeling circuit; and a forth voltage at a third node between the third impedance circuit and the fourth impedance circuit on the first branch of the modeling circuit.

5. The electronic device of claim 3, wherein:

the first impedance circuit comprises a first resistor that models resistance of the passivation layer and a first capacitor coupled in parallel with the first resistor that models capacitance of the passivation layer;

the second impedance circuit comprises a second resistor that models resistance of the liquid crystal layer and a second capacitor coupled in parallel with the second resistor that models capacitance of the liquid crystal layer;

the third impedance circuit comprise a third resistor that models resistance of the passivation layer and a third capacitor coupled in parallel with the third resistor that models capacitance of the passivation layer; and the fourth impedance circuit comprises a fourth resistor that models resistance of the dielectric layer and a fourth capacitor coupled in parallel with the fourth resistor that models capacitance of the dielectric layer.

6. The electronic device of claim 1, comprising:

a display pipeline communicatively coupled to the control circuitry, wherein the display pipeline is configured to:

receive input image data that indicates target luminance of the display pixel in the image frame; and generate pixel response corrected image data by adjusting the input image data based at least in part on the expected charge accumulation; and a display driver communicatively coupled to the display pipeline, wherein the display driver is configured to generate and supply the analog electrical signal to the display pixel based at least in part on the pixel response corrected image data to facilitate offsetting charge accumulation expected to be present in the display pixel when the image frame is to be displayed.

7. The electronic device of claim 6, wherein the display pipeline is configured to generate the pixel response corrected image data to facilitate compensating for variations in pixel response of the display pixel expected to be caused by the expected charge accumulation in the display pixel when the image frame is to be displayed.

8. The electronic device of claim 1, wherein the control circuitry is configured to:

determine intervening operational parameters that occur between a previous display pixel state and a time when the image frame is to be displayed; and determine the expected charge accumulation in the display pixel when the image frame is to be displayed by iterating the previous display pixel state based at least in part on the intervening operational parameters.

9. The electronic device of claim 1, wherein the third electric field, modeled by the third branch, flows from the pixel electrode to the common electrode without passing through the liquid crystal layer.

10. The electronic device of claim 1, wherein the control circuitry is configured to:

determine an operating mode of the display panel, wherein the display panel is configured to:

cease displaying image frames when operating in a sleep mode;

display one or more image frames with a fixed refresh rate when operating in an auto mode; and display the one or more image frames with a variable refresh rate when operating in a normal mode; and in response to operating in the normal mode:

determine a previous display pixel state indicative of the expected charge accumulation in the display pixel when a directly previous image frame was to be displayed; and determine a current display pixel state indicative of the expected charge accumulation in the display pixel when the image frame is to be displayed by iterating the previous display pixel state based at least in part on magnitude of a previous analog electrical signal supplied to the display pixel to display the directly previous image frame, voltage polarity of the previous analog electrical signal, refresh rate of the directly previous image frame, display duration of the directly previous image frame, or any combination thereof.

11. The electronic device of claim 10, wherein, when the display panel switches from the sleep mode or the auto mode to the normal mode directly before the image frame is to be displayed, the control circuitry is configured to:

determine an initial display pixel state indicative of the expected charge accumulation in the display pixel when the display panel initially switched to the sleep mode or the auto mode; and determine the current display pixel state indicative of the expected charge accumulation in the display pixel when the image frame is to be displayed by iterating the initial display pixel state based at least in part on duration the display panel operates in the sleep mode or the auto mode before switching to the normal mode and environmental parameters present while the display panel operated in the sleep mode or the auto mode.

12. The electronic device of claim 1, wherein the electronic device comprises a portable phone, a media player, a personal data organizer, a handheld game platform, a tablet device, a computer, or any combination thereof.

13. A method for operating an electronic display to display image frames, comprising:

determining, using a controller, a first display pixel state indicative of charge accumulation expected to be present in a display pixel of the electronic display due to display of a first image; and in response to the electronic display switching to an auto refresh mode or a sleep mode from a variable refresh mode, immediately before a second image is to be displayed after the first image:

determining, using the controller, environmental parameters occurring while the electronic display was in the variable refresh mode;

determining, using the controller, a duration that the electronic display was in the variable refresh mode;

determining, using the controller, a second display pixel state indicative of the charge accumulation expected to be present in the display pixel when the second image is to be displayed by iterating the first display pixel state based at least in part on the environmental parameters occurring while the electronic display was in the variable refresh mode and the duration the electronic display was in the variable refresh mode without iterating the first display pixel state while the electronic display is in the variable refresh mode; and instructing, using the controller, the electronic display to display the second image by supplying an analog electrical signal to the display pixel based at least in part on the second display pixel state indicative of the charge accumulation expected to be present in the display pixel when the second image is to be displayed.

14. The method of claim 13, wherein:

the display pixel comprises a pixel electrode, a passivation layer, a liquid crystal layer, a dielectric layer, and a common electrode; and determining the first display pixel state comprises determining the first display pixel state based at least in part on a modeling circuit, wherein:

the modeling circuit models:

a first branch that describes a first electric field that flows from the pixel electrode, through the passivation layer, through the liquid crystal layer, back through the passivation layer, through the dielectric layer, to the common electrode;

a second branch coupled in parallel with the first branch that describes a second electric field that flows from the pixel electrode, through the passivation layer, through the dielectric layer, to the common electrode; and a third branch coupled in parallel with the second branch that describes a third electric field that flows from the pixel electrode, through the dielectric layer, to the common electrode; and the first display pixel state is modeled, at least in part, by:

a first voltage at a first node between a first impedance circuit and a second impedance circuit on the first branch of the modeling circuit;

a second voltage at a second node between the second impedance circuit and a third impedance circuit on the first branch of the modeling circuit; and a third voltage at a third node between the third impedance circuit and a fourth impedance circuit on the first branch of the modeling circuit.

15. The method of claim 13, comprising:

instructing, using the controller, the electronic display to display the first image while the electronic display is in the variable refresh mode; and instructing, using the controller, the electronic display to display a third image directly after the first image while the electronic display is in the variable refresh mode without iterating the first display pixel state before the third image is displayed on the electronic display.

16. The method of claim 13, comprising:

instructing, using the controller, the electronic display to display the first image in the variable refresh mode; and instructing, using the controller, the electronic display to switch to the auto refresh mode or the sleep mode after the first image is displayed.

17. The method of claim 13, comprising instructing, using the controller, a display pipeline to generate pixel response corrected image data to be used to display the second image by adjusting input image data that indicates target luminance of the display pixel based at least in part on the second display pixel state indicative of the charge accumulation expected to be present in the display pixel when the second image is to be displayed, wherein instructing the electronic display to display the second image comprises instructing the electronic display to generate and supply the analog electrical signal to the display pixel based at least in part on the pixel response corrected image data to facilitate offsetting the charge accumulation expected to be present in the display pixel when the second image is to be displayed.

* * * * *